US009925676B2

(12) United States Patent
Krenik

(10) Patent No.: US 9,925,676 B2
(45) Date of Patent: Mar. 27, 2018

(54) AUTOMATED HAIR CUTTING SYSTEM AND METHOD OF OPERATION THEREOF

(71) Applicant: Matthew W. Krenik, Garland, TX (US)

(72) Inventor: Matthew W. Krenik, Garland, TX (US)

( * ) Notice: Subject to any disclaimer, the term of this patent is extended or adjusted under 35 U.S.C. 154(b) by 420 days.

(21) Appl. No.: 14/365,935

(22) PCT Filed: Dec. 20, 2012

(86) PCT No.: PCT/US2012/070856

§ 371 (c)(1),
(2) Date: Jun. 16, 2014

(87) PCT Pub. No.: WO2013/096572

PCT Pub. Date: Jun. 27, 2013

(65) Prior Publication Data

US 2015/0197016 A1 Jul. 16, 2015

Related U.S. Application Data

(60) Provisional application No. 61/578,717, filed on Dec. 21, 2011, provisional application No. 61/610,021, filed on Mar. 13, 2012, provisional application No. 61/677,532, filed on Jul. 31, 2012.

(51) Int. Cl.
*B26B 19/38* (2006.01)
*B26B 21/40* (2006.01)

(52) U.S. Cl.
CPC ..... *B26B 19/388* (2013.01); *B26B 19/3806* (2013.01); *B26B 21/4081* (2013.01); *Y10T 83/04* (2015.04)

(58) Field of Classification Search
CPC ..... B26B 19/388; B26B 19/3806; B26B 21/4081; Y10T 83/04
USPC ..... 83/13; 30/123
See application file for complete search history.

(56) References Cited

U.S. PATENT DOCUMENTS

| | | | | |
|---|---|---|---|---|
| 3,054,183 | A | 9/1962 | Zucker | |
| 3,413,985 | A | 12/1968 | Dlouhy et al. | |
| 3,536,079 | A | 10/1970 | Dlouhy et al. | |
| 4,602,542 | A * | 7/1986 | Natrasevschi | B26B 19/00 132/214 |
| 6,973,931 | B1 | 12/2005 | King | |
| 2004/0004559 | A1 | 1/2004 | Rast | |

(Continued)

FOREIGN PATENT DOCUMENTS

| | | | |
|---|---|---|---|
| FR | 2964023 | A1 | 3/2012 |
| GB | 2462812 | A | 2/2010 |
| WO | 2013096572 | A1 | 6/2013 |

*Primary Examiner* — Omar Flores Sanchez
(74) *Attorney, Agent, or Firm* — Richard G Eldredge; Eldredge Law Firm

(57) ABSTRACT

Methods and devices for automatically cutting hair are disclosed herein. In one embodiment, an automated system for cutting hair on a subject comprises a hair cutting device, configured for manual manipulation, the hair cutting device comprising a cutting mechanism and configured to engage the cutting mechanism to cut said hair. The automated system also comprises a positioning device coupled to the subject, the positioning device configured to interact with the cutting device for determining a position of the hair cutting device relative to the subject.

22 Claims, 20 Drawing Sheets

(56) References Cited

U.S. PATENT DOCUMENTS

| | | | | |
|---|---|---|---|---|
| 2009/0303320 | A1 | 12/2009 | Davis | |
| 2010/0186234 | A1* | 7/2010 | Binder | A45D 26/00 30/34.05 |
| 2011/0018985 | A1 | 1/2011 | Zhu | |
| 2013/0021460 | A1* | 1/2013 | Burdoucci | B26B 19/388 348/77 |
| 2014/0137883 | A1* | 5/2014 | Rothschild | B26B 19/388 132/200 |
| 2015/0020658 | A1* | 1/2015 | Eljaouhari | B26B 19/388 83/13 |
| 2015/0217465 | A1* | 8/2015 | Krenik | B26B 19/388 700/90 |
| 2015/0298325 | A1* | 10/2015 | Taijeron | B26B 19/3826 33/281 |
| 2015/0352735 | A1* | 12/2015 | Matthews | B26B 19/382 30/123 |

* cited by examiner

AUTOMATED HAIR CUTTING SYSTEM AND METHOD OF OPERATION THEREOF

CROSS-REFERENCE TO RELATED APPLICATION

This application is a national stage application of PCT Application No. PCT/US12/70856, filed Dec. 20, 2012, which claims the benefit of U.S. Provisional Application Ser. No. 61/578,717 filed on Dec. 21, 2011; U.S. Provisional Application Ser. No. 61/610,021 filed on Mar. 13, 2012; and U.S. Provisional Application Ser. No. 61/677,532 filed on Jul. 31, 2012, all filed by Matthew W. Krenik, entitled "Automated Hair Cutting System," commonly owned with this application and incorporated herein by reference.

TECHNICAL FIELD

This application is directed, in general, to hair-cutting systems and, more specifically, to an automated hair-cutting system.

BACKGROUND

A very large number of professional barbers, hair stylists, and other professionals provide hair cutting services in most countries of the world. The importance in society of having well-groomed hair is highlighted by significant sums of money and time spent for these services. The substantial cost of a haircut and the time and inconvenience associated with getting one makes the idea of automated hair cutting systems attractive. Today, there are a number of systems available that provide guides, cutters, training materials, and other approaches to make it somewhat easier to cut hair without the need for extensive training. Regrettably, these systems are difficult to use for most people and often strictly limit the number of hair styles possible. Simple hair length guides, mechanical combs mounted on cutter heads, hair cutters mounted on vacuum hoses, and other common approaches do not allow people to generate most of the stylish and well-groomed results they seek. It is therefore desirable to have a system allowing a person without extensive training to accurately cut hair.

In light of the benefits an automated hair cutting system provides, several attempts at such a system have been made. In U.S. Pat. No. 3,054,183, Zucker teaches a mechanical guide that adjusts a cutter head as it is moved across a person's scalp. The simple, mechanical design Zucker offers does not allow a wide variety of hair styles, and its rolling wheels or sliding mechanical guides may tend to smash some hair down, making it harder to access and cut properly. In U.S. Pat. No. 3,413,985, Dlouhy teaches a helmet fitted over a person's head and aligned with ear retractors that insert into the person's ears. Multiple cutter heads are used inside the helmet to cut hair. Dlouhy teaches a rigid helmet, many cutter heads and a large, heavy mechanism that would necessarily be expensive, bulky, and uncomfortable to use.

In U.S. Pat. No. 4,602,542, Natrasevschi teaches a frame rigidly holding a person's head and a robotic arm that cuts hair. Hair length is controlled with an adjustable vacuum stretcher tube and rotary cutter tube. Such a system would be necessarily expensive, bulky, and uncomfortable. In addition, the end of Natrasevschi's hair cutter always touches the person's head so it may smash hair down and the maximum length that hair may be cut is physically limited by the length of the cutter tube and stretcher tube. Employment of longer tubes would make the hair cutter unwieldy and interchangeable tubes, while perhaps possible, would be inconvenient. In U.S. Patent Application 2004/0004559, Rast teaches a hair cutter with some features similar to Natrasevschi. Rast also suffers from limitations on hair length and the need to make physical contact with a person's head to position his hair cutter. Rast explains how position of his hair cutter may be determined using electronic sensors, but depends on his mechanical separator sleeve (similar in some sense to Natrasevschi's stretcher tube) to determine position above the scalp. Hence, hair is always potentially mashed down, and there are clear limitations on possible styles and hair length.

It is also noteworthy that the hair cutting devices of Natrasevschi and Rast, like many available on the market today, operate by continuously operating their cutter heads such that any hair that contacts the cutter heads is cut once engaged. Such approaches lead to a noisy environment as the hair cutting device will normally buzz or at least hum through the course of a haircut and the continuous operation of the cutter head leads to additional wear on moving parts and unnecessary consumption of power.

SUMMARY

One aspect provides an automated hair cutting system. In one embodiment, the system includes: (1) a hair cutting device configured to engage a cutting mechanism to cut the hair on a subject and (2) a positioning structure operable to interact with the hair cutting device to determine a position of the hair cutting device relative to a reference point.

Another aspect provides an automated system for cutting hair on a subject. In one embodiment, the system includes: (1) a hair cutting device having a plurality of engagable blades proximate comb teeth and controlled to to allow the hair to be combed through the comb teeth and cut by the engagable blades after extension of the hair and (2) a positioning structure operable to interact with the hair cutting device to determine a position of the hair cutting device.

Yet another aspect provides a method of employing a hair cutting device to cut hair on a subject to conform to a specified style. In one embodiment, the method includes: (1) associating a positioning structure with the subject, the associating detecting but not impeding movement of the subject, (2) sensing a position of the hair cutting device and (3) engaging a cutting mechanism of the hair cutting device if the position correlates with the specified style.

BRIEF DESCRIPTION

Reference is now made to the following descriptions taken in conjunction with the accompanying drawings, in which.

DETAILED DESCRIPTION

Before describing various embodiments of the automated hair cutting system and method, techniques for controlling and monitoring a position of a hair cutting device will be generally described.

It is realized herein that the position of a hair cutting device may be monitored relative to a subject such that it cuts hair at specified locations and times yielding a desired haircut. It is further realized herein that a positioning structure may be used in monitoring the position of a hair cutting device relative to a subject and that various embodiments of a positioning structure are possible. It is further realized herein that such a positioning structure may include a positioning device having positioning interfaces that is coupled to a subject. It is further realized herein that such a positioning structure may include a camera for monitoring a subject, or for monitoring a positioning device, or for monitoring both a subject and a positioning device. It is realized herein that reference points on the subject's face may be employed to provide greater flexibility in the shape of the positioning device and the precision with which it is coupled to the subject. It is further realized herein the positioning device need only be stable relative to the subject during operation.

It is realized herein the positioning structure may interact with the hair cutting device to determine the position and orientation of the hair cutting device relative to the subject. It is realized herein scalp outlines and tables may be employed to provide hair cut information. Hair cut information may include: hair length per region, scalp irregularities, color, presence of thinning hair, or many other hair characteristics. It is further realized herein that an electronic computing device may be employed to carry out computations associated with control of the automated hair cutting system, interact with sensors, and to provide a user interface. It is realized herein the electronic computing device may be a computer, cell phone, computerized tablet or a variety of other devices.

It is realized herein a person receiving a haircut may operate the system or have another person operate it. A person operating the system cuts hair by responding to guidance from the system that may be provided through the positioning device, the hair cutting device, the electronic computing device or possibly other devices of the system.

It is also realized herein that the automated hair cutting system may be applied to cutting hair on the subject's scalp and face (moustache and beard hair in addition to scalp hair) and may also be applied to other fields where precise relative alignment of a tool or other device to another object provides benefit. It is realized herein medical surgery systems, drug delivery systems, robotic systems, machine tools, cutting systems, and many other systems may benefit from the teaching of the system and method.

Figure 1:
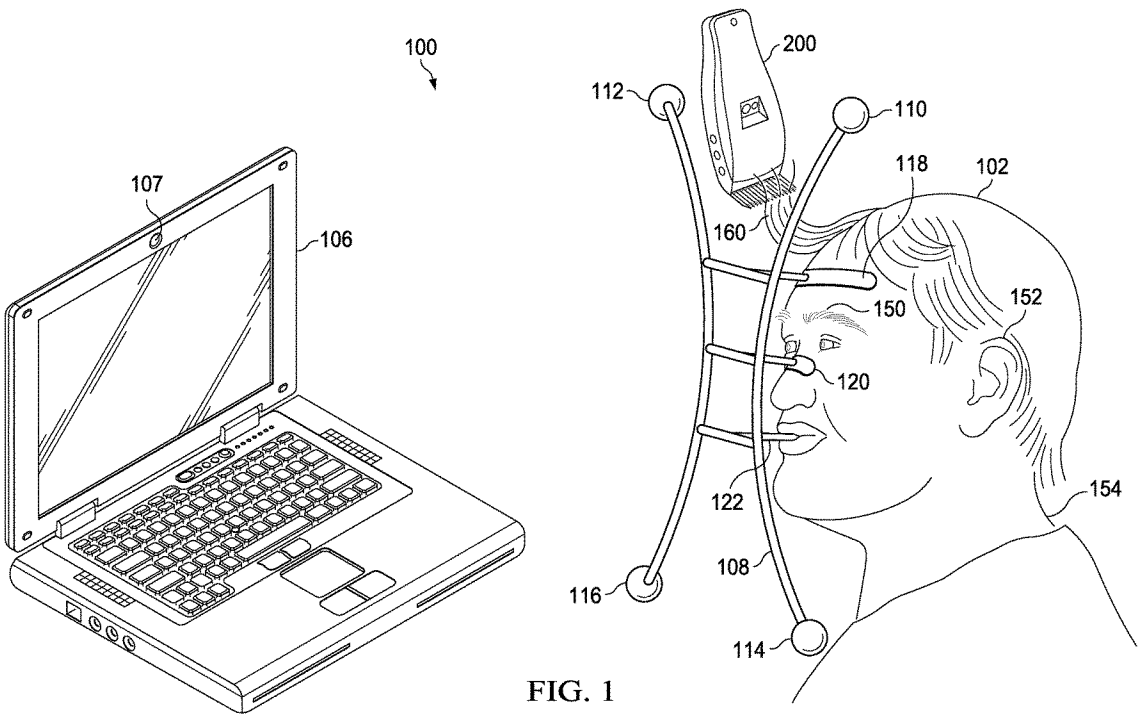
FIG. 1 is an illustration of one embodiment of an automated hair cutting system including a user, a positioning device, a hair cutting device and an electronic computing device.

FIG. 1 shows an embodiment of an automated hair cutting system 100 including a user 102, a positioning device 108, a hair cutting device 200, and an electronic computing device 106. Electronic computing device 106 may be embodied as a cell phone, tablet computer, notebook computer, desktop computer, or other computing device. Electronic computing device 106 may include a display screen, touchscreen, buttons, cursor controls, joysticks, cameras 107, speakers, buzzers, microphones, haptics, indicator lights, software, electronic interfaces, and other elements that may allow electronic computing device 106 to interface to user 102, positioning device 108, and hair cutting device 200. Cameras 107 may be used to provide useful information to other elements of automated hair cutting system 100 and additional cameras may be provided on positioning device 108, on hair cutting device 200, or additional standalone cameras or cameras mounted on other elements of some embodiments. Electronic computing device 106 may also include wired or wireless electronic interfaces to positioning device 108, hair cutting device 200, and possibly to elements not shown in FIG. 1 such as the Internet, Internet servers, cloud computing elements, or other devices. No wires are shown in FIG. 1 to avoid clutter; however, wired interfaces between electronic computing device 106, positioning device 108, and hair cutting device 200 may provide power and communications. Wired interfaces such as Universal Serial Bus (USB), P1394, Thunderbolt and many other wired interfaces that provide communications or power to the devices in FIG. 1 are possible. Wireless interfaces between electronic computing device 106, positioning device 108, and hair cutting device 200 are also possible and may provide power or communications. Wireless interfaces such as Bluetooth, Bluetooth Low Energy, WiFi (IEEE 802.11), Zigbee, and other wireless interfaces are also possible. Electronic computing device 106, positioning device 108, and hair cutting device 200 may receive power over wired or wireless connections, and may also receive power from batteries that may be disposable batteries or rechargeable batteries.

In FIG. 1, positioning device 108 is secured to the face of user 102 through forehead support 118, nose support 120, and mouth support 122. Certain embodiments of the automated hair cutting system 100 may not include a positioning device 108. Such embodiments may use cameras observing user 102 or may use other embodiments of positioning structures suitable for monitoring position and/or orientation of hair cutting device 200 relative to user 102. Forehead support 118 and nose support 120 may employ suction cups, vacuum, textured surfaces, non-slip surfaces, adhesive, tape, two-sided tape (i.e., tape having adhesive on both sides), springs, mechanical structures, or other techniques to secure positioning device 108 temporarily to the face of user 102 so that it remains substantially in place during some operations of automated hair cutting system 100. Mouth support 122 may be embodied as a tab or other feature that may be contoured or formed to fit comfortably to the teeth of user 102 or other features of the mouth of user 102. Mouth support 122 may be bitten on by user 102 such that it remains securely aligned to the head of user 102 during some operations of automated hair cutting system 100. Additional embodiments of positioning device 108 may be secured to the face of user 102 through additional elements contacting the eye sockets, cheeks, temples, ears, or other features of the face of user 102. Certain embodiments of positioning device 108 may use any combination of forehead support 118, nose support 120, or mouth support 122 to secure positioning device 108 to the face of user 102. Embodiments are also possible in which positioning device 108 is secured to the shoulders, neck, arms, or other parts of the body of user 102. However, embodiments of positioning device 108 that primarily contact the head of user 102 and maintain alignment and position substantially constant relative to the head, and consequently, the hair and scalp, are also useful.

Positioning device 108 as embodied in FIG. 1 also includes positioning interfaces: a first positioning interface 110, a second positioning interface 112, a third positioning interface 114, and a fourth positioning interface 116. The positioning interfaces may transmit signals that are received by sensors on hair cutting device 200 so that the position and orientation of hair cutting device 200 may be determined relative to positioning device 108. The signals transmitted from the positioning interfaces may be radio signals or other electromagnetic signals, acoustic sound signals, audible sound signals, ultrasonic signals, optical signals, light signals, infrared signals, or other possible signals that may be transmitted from the positioning interfaces and received by sensors on hair cutting device 200 such that distances from the positioning interfaces to sensors on hair cutting device 200 may be determined. Analysis of signal propagation time (sometimes referred to as time-of-flight analysis), analysis of signal propagation angles (as is sometimes done in radar, lidar, and sonar systems), or any other method or technique of signal analysis may be used. It is noted that in some cases, the distances determined from, for example, first positioning interface 110 to a sensor on hair cutting device 200 may be a direct line-of-sight distance, or may represent the distance of the path taken by the signal from first positioning interface 110 to the noted sensor on hair cutting device 200. If acoustic sound signals are used, for example, they will travel around the head of user 102 and may not always provide a line-of-sight distance. Optical signals, light signals, infrared signals, and some other signals, on the other hand, would normally provide a line-of-sight distance, but suffer the disadvantage that they may be blocked by the hands, arms, hair, or head of user 102 or by other possible obstructions to the signal's path.

Likewise, in the embodiment of FIG. 1, signals may also be transmitted from transmitters on hair cutting device 200 and received by sensors located at the positioning interfaces. Since computation of the position or orientation of hair cutting device 200 relative to positioning device 108 is desired, the system and method may be served by signals propagating in either direction. Certain embodiments employ some signals transmitted from the positioning interfaces and other signals transmitted from hair cutting device 200. Other embodiments employ a combination of signals: radio and acoustic sound, audible sound and ultrasonic, optical and light, ultrasonic and infrared, etc.

Some embodiments of positioning device 108 may allow the distances between some or all of the positioning interfaces to be determined electronically using signal propagation techniques or other techniques explained in this patent applications, or other techniques available in the prior art. Some embodiments of positioning device 108 may be sufficiently rigid that the distances between some or all of the positioning interfaces are known due to the construction of positioning device 108 (or they could be measured and recorded after positioning device 108 is manufactured). In any case, if the distances between positioning interfaces are known, they may be used in support of computations to determine the position and/or orientation of hair cutting device 200. For example, in FIG. 1, if the distance between first positioning interface 110 and third positioning interface 114 is known, it may be used directly in position and/or orientation calculations. Hair cutting device 200 may contain multiple sensors and the distances between those sensors may be used in position and orientation calculations.

Additional signals may also pass between positioning device 108 and hair cutting device 200. These additional signals may pass through the positioning interfaces to and from hair cutting device 200 or through other wired or wireless interfaces between positioning device 108 and hair cutting device 200. These additional signals may also pass through or be coordinated by electronic computing device 106. These additional signals may relate to timing synchronization, system control, system security, system safety, device authentication, device capability, device model numbers, or many other aspects of the operation of automated hair cutting system 100.

Embodiments of automated hair cutting system 100 may employ a wide variety of signals and techniques to compute positions and orientation. These signals and techniques include: orthogonal signals, CDMA (code division multiple access), TDMA (time division multiple access), FDMA (frequency division multiple access), OFDMA (orthogonal frequency division multiple access), ultra-wide band signals, chirp signals, radar signals, sonar signals, lidar signal, and many others. Signals passing to or from the positioning interfaces from or to hair cutting device 200 may be modulated (AM, FM, PSK, FSK, MSK, QAM, or any other possible modulations may be used) or otherwise coded or configured to contain timing, synchronization, control, data, identification of multipath signal components, security codes, information to ensure proper operation, and redundancy. Signals passing to or from the positioning interfaces from or to hair cutting device 200 may include Gold codes, PN codes, M-Sequence codes, Walsh codes, Walsh-Hadamard codes, or any other coding. In certain embodiments, signals passing to or from the positioning interfaces to electronic hair cutting device 200 may include multipath components, Doppler errors due to motion, signal fades, and may at times be blocked or modified by the arms of user 102, other people, or other objects, making it difficult to accurately determine distance from the positioning interfaces to sensors on electronic hair cutting device 200. For such embodiments, signal processing techniques and signals may be applied that assist in dealing with multipath, Doppler errors, fading, obstructions, and other non-ideal situations. CDMA signals, for example, may benefit some embodiments regarding multipath, fades, or blocked signal paths. Additionally, signal processing algorithms such as optimal estimators, Kalman filters, and other techniques may be helpful in some embodiments to accurately determine position or orientation of hair cutting device 200.

Power control techniques similar to those used in communications systems may also be employed in an automated hair cutting system 100. Weak or redundant transmitters (such as transmitters operating in signal paths experiencing fading, or transmitters that are not needed as other transmitters are providing enough signals to substantially ensure accurate information) in positioning interfaces or hair cutting device 200 may be temporarily powered off to reduce interference and also to save power. As hair cutting device 200 may contain multiple sensors, power control signals from hair cutting device 200 to positioning device 108 to control the power levels of the positioning interfaces on positioning device 108 may be employed to provide acceptable signal power at the multiple sensors on hair cutting device 200.

As some embodiments of positioning device 108 may include speakers, acoustic drivers, or other elements that may cause physical motion or vibration, such embodiments may employ techniques to reduce the effect of vibration. Vibration may be uncomfortable to users and physical motion of positioning device 108 may cause errors or loss of precision in position measurements. Positioning interfaces containing audible sound or ultrasound speakers, for example, may employ signaling that randomizes signals, such as CDMA signals or other signal processing techniques. Differential signals may be employed to cancel vibration. Certain embodiments may employ ballast on positioning device 108 to increase its mass to reduce vibration or power control signal processing schemes that minimize the drive level to the positioning interfaces. Positioning interfaces out of range, blocked by the head of user 102, or otherwise occluded may be powered off to save power and minimize vibration.

Automated hair cutting system 100 may also compensate automatically for changes in environmental parameters that may affect signal propagation, and hence, give rise to positioning errors if not accounted for. For example, if ultrasound, audible sound, or other sound signals are used, the propagation speed of sound will change with temperature, air pressure, and humidity. Automated hair cutting system 100 may include temperature, air pressure, and humidity sensors so that the effect of these environmental parameters on positioning accuracy may be compensated to achieve substantially accurate results. Alternatively, positioning device 108 may be constructed so that at least two of the positioning interfaces it contains are substantially rigidly fixed apart from each other at a substantially fixed distance; and for such an embodiment, positioning device 108 may have the ability to directly measure the distance from one positioning interface to the other that is substantially rigidly fixed a known distance from it. In such a case, the distance between the substantially rigidly spaced positioning interfaces can be measured directly by signal propagation and compared to the known rigidly fixed distance. In this way, the effect of environmental parameters may be directly assessed so that appropriate compensations may be determined. Some embodiments of an automated hair cutting system 100 may provide positioning interfaces a known substantially rigidly fixed distance apart on some other structure, besides positioning device 108 as explained here, and determine compensation for environmental parameters in an otherwise similar way.

Positioning device 108 may be battery powered with disposable or rechargeable batteries or may be powered through a wired or wireless connection. The positioning interfaces are shown in FIG. 1 as spheres, but may also be embodied in a wide variety of other shapes and sizes. Special shapes and/or sizes for the positioning interfaces may provide benefit in some embodiments in allowing improvement of transmitted or received signal propagation and to allow easy identification of them if computer vision systems or other image processing is used. For example, if radio signals are used, the positioning interfaces may benefit if they are sized to provide room to allow effective radio antennas to be incorporated inside them or if they are formed to directly provide antenna functions. Positioning interfaces and the circuits and elements they contain may also be configured to enhance signal propagation in specific directions of interest so that reduced power levels, enhanced signal levels, or other benefits may be obtained. It is also noted that while the embodiment of FIG. 1 makes use of four positioning interfaces, embodiments with more or less positioning interfaces are possible. While it may seem necessary to have at least four positioning interfaces to establish a position in space, it is noted that since operation of some embodiments of automated hair cutting system 100 may be limited to determining position on and/or above a user's 102 head, embodiments may be possible that use only one or two positioning interfaces, especially if the range of hair styles is limited to simple styles or only some parts of a user's hair are to be cut (for example, if such an embodiment was intended only as a beard or moustache trimmer). Of course, additional positioning interfaces may provide benefit in more accurately and consistently determining position and orientation. As noted above regarding blocked signal paths and multipath, the incorporation of additional positioning interfaces may provide redundancy that may allow more robust system operation in the face of detrimental conditions.

It is also possible to use a camera 107 on electronic computing device 106 or another camera or cameras in automated hair cutting system 100 as elements of a positioning structure to determine the position and/or orientation of hair cutting device 200 relative to the head of user 102. In such an embodiment, position and/or orientation information from such a camera or cameras may be used separately or in conjunction with positioning information from positioning device 108 for operation of automated hair cutting system 100. Cameras, in such embodiments, may be incorporated into electronic computing device 106, positioning device 108, hair cutting device 200, or into additional devices not shown in the embodiment of FIG. 1. Cameras incorporated in automated hair cutting system 100 may determine position and/or orientation information of the head of user 102 and/or hair cutting device 200 through observation and computational analysis of the head and/or facial features of user 102, features of positioning device 108, and possibly through observation of other elements such as features of a room or other features not shown in FIG. 1. Special features such as targets, special shapes, symbols, or other features may be incorporated to make the determination of positions and orientations easier and more reliable. For example, the incorporation of easily recognized shapes on positioning device 108 may be helpful (this will be further explained with regard to FIG. 7E and FIG. 7F). Structured light or other special illumination techniques may also be applied to benefit the determination of features, distances, and other elements that may be helpful in determining positions and orientations. It is noted that use of structured light may be used for illumination of positioning interfaces and other possible features of a positioning device 108, or structured light may be used to directly illuminate the face or head of a user 102 so that positioning information may be determined directly from analysis of images or video of a user 102 under illumination of structured light.

Images and video generated from cameras incorporated into automated hair cutting system 100 may also be displayed on electronic computing device 106 or other electronic displays that may be available (but are not shown in FIG. 1) to assist user 102 in positioning hair cutting device 200 beneficially so that the hair of user 102 may be successfully cut.

Some embodiments of positioning device 108 may further include accelerometers or gyroscopes or other sensors that allow automated hair cutting system 100 to monitor motion, orientation, or position of positioning device 108. Such embodiments may allow automated hair cutting system 100 to pause operation if it is determined through monitoring the accelerometers or gyroscopes or other sensors that positioning device is being moved so rapidly that significant positioning errors may occur. For example, if user 102 shakes their head rapidly, positioning device 108 may bend or flex so that the positioning interfaces move relative to each other and no longer provide correct or consistent information. Rapid motion of the head of user 102 may also cause positioning device 108 to shift in position on the face of user 102. If such conditions occur, embodiments of positioning device 108 including accelerometers and/or gyroscopes or other sensors may provide benefit in pausing operation, guiding user 102 to move more slowly and/or smoothly, and possibly in guiding user 102 to re-position positioning device 108 if it may have moved from its proper location relative to the head of user 102.

The embodiment of positioning device 108 in FIG. 1 may provide benefit in that positioning device 108 is formed primarily in the front and sides of the face of user 102. Such a design may allow user 102 to access their head and hair with their arms and minimizes the degree to which positioning device 108 obstructs access. As will be shown subsequently, many additional embodiments of positioning devices are also possible that offer benefit for some embodiments of automated hair cutting systems 100. It is also noted that electronic computing device 106 may be placed on a counter, a stand, or affixed to a mirror or wall in front of user 102 so that user 102 has both hands substantially free and may operate hair cutting device 200 with one hand while positioning hair, possibly with a comb or other device, with his or her other hand. Automated hair cutting system 100 may also be configured to provide audible prompts, visible signals, and respond to voice commands and signals from user 102 so that it operates substantially in a hands-free fashion. The structure of positioning device 108 may be provided using metals, tubing, plastics, wood, or other materials and the electronics, switches, buttons, batteries, antennas, microphones, speakers, and other elements needed for various embodiments may be positioned within or on the structure of positioning device 108.

Hair cutting device 200 will be described later and multiple embodiments and features will be shown. In the embodiment of FIG. 1, hair cutting device 200 is held by user 102 or another person and is manually positioned to collect and cut the hair of user 102. As illustrated in FIG. 1, hair cutting device 200 may collect a region of hair 160 and extend it so that automated hair cutting system 100 may actuate the cutter head of hair cutting device 200 at a substantially precise point of time when the region of hair 160 is at a substantially correct length. Through repeated operation of selecting and extending regions of hair so that they may be cut, user 102 or another person manually positioning hair cutting device 200 may substantially cut the hair of user 102 to create a desired hair style. It is noted with regard to FIG. 1 that hair cutting device 200 may operate to cut the hair of user 102 responsive to signals and/or information from a positioning device 108, from inputs from a user 102, and possibly also from an electronic computing device 106. With this basic understanding of hair cutting device 200, operation of automated hair cutting system 100 may be further described.

Figure 13:
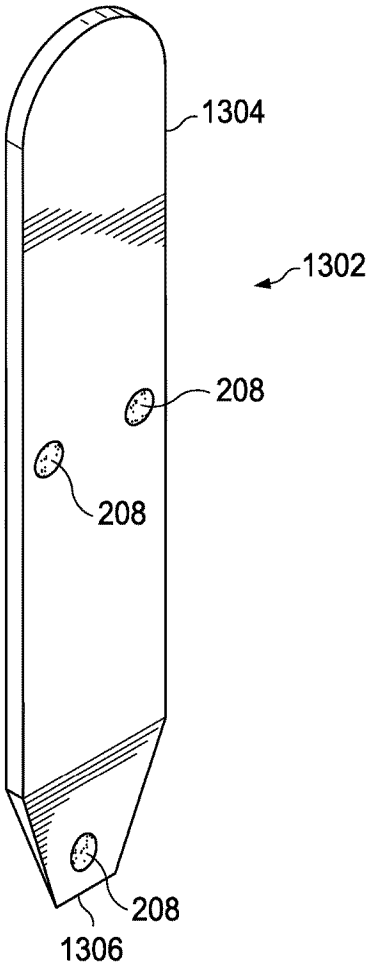
FIG. 13 is an illustration of one embodiment of a stylus.

Operation of automated hair cutting system 100 may embody many different sequences and approaches that may provide benefit depending on the nature of user's 102 hair and the style and hair length he or she is seeking. In order to illustrate some possible embodiments, an embodiment of operation of automated hair cutting system 100 is now explained. User 102 may first clean their hair and comb it to avoid tangles. For some individuals or hair styles, wetting hair with water, gel, or other solutions may be beneficial. Electronic computing device 106 may then be enabled and consulted for potential styles that may be applied. A camera 107 on electronic computing device 106 may collect images of user 102 and assess their present hair length and style and determine what styles and lengths are possible with user's 102 hair. User 102 may also measure their hair and input that information into electronic computing device 106. Automated hair cutting system 100 may be used to aid or automate measurement of user's 102 hair. User 102 may also input information about the type or shape of scalp or skull they have. Electronic computing device 106 may show user 102 examples of how she might look after their haircut is complete. User 102 may also receive options for modifications or combinations of styles and may select these through electronic computing device 106. Once user 102 determines a style and hair length using the interfaces on electronic computing device 106, electronic computing device 106 may prompt user 102 to secure positioning device 108 to their face and turn it on. Electronic computing device 106 may then prompt user to turn on hair cutting device 200. Electronic computing device 106 may then temporarily disable the cutting action of hair cutting device 200 and direct user 102 to touch the idle cutter head of hair cutting device 200 to reference points on the user's 102 head. Reference points may be used to determine the location of first positioning interface 110, second positioning interface 112, third positioning interface 114 and fourth positioning interface 116 relative to the head and hair of user 102. These reference points may include the tops of user's ears 152, the back of user's neck at a collar line 154, the tops of user's eyebrows 150, and other reference points that are of specific interest in properly fitting a given hairstyle to a user's 102 head and facial features. Other reference points might include the front or back of a user's ears, the sides of a user's 102 eye sockets, the user's 102 hair line (the point at which the user's 102 hair scalp ends and skin without thick hair begins) at various points around the user's 102 scalp, desired locations for hair parts (the common meaning of a hair part is used here, that is, where the hair is combed apart in different directions to create a line-like feature in the hair), where hair jewelry is worn, where hair dye is present, or other features of specific hair styles, and other reference points. Additional reference points may be touched by user 102 at direction from electronic computing device 106 to help electronic computing device 106 determine the size and shape of user's 102 head and determine the location of first positioning interface 110, second positioning interface 112, third positioning interface 114 and fourth positioning interface 116 relative to the head and hair of user 102. It is noted that for the purpose of determining the location of positioning interfaces, use of reference points such as the tops of the user's ears 152, the tops of the user's eyebrows 150, and other reference points that are substantially consistent may be favored over use of reference points like the location of hair dye, hair parts, and other reference points that may vary depending on hair growth, combing, or other variable factors. Alternatively, instead of using hair cutting device 200 for mapping the reference points as noted, a stylus 1302 (an embodiment of such a stylus 1302 is shown in FIG. 13), different hair cutting device, or other reference device may be used to provide reference point positions. Reference points may be established through a user touching a hair cutting device 200, stylus 1302, or other suitable device to the predefined reference point on their head or face and acknowledging (through a button press, audible sound, or other suitable signal—or alternatively, automated hair cutting system 100 may observe the user and determine from computer vision analysis when a reference point has been touched) to automated hair cutting system 100 that the reference point is being touched. The use of reference points allows precise information regarding the location of a specific region of hair on user 102 to be determined relative to reference point features of user 102 without the need for positioning device 108 to be precisely positioned relative to the face of user 102 (positioning device 108 need only be stable relative to the face of user 102 through the course of a haircut). Consequently, embodiments of automated hair cutting system 100 including the use of reference points as described, may provide convenience to people using them (since positioning device 108 need not be precisely aligned to their face, but only needs to be stable for the duration of a haircut) and also allow for a wide range of shapes, sizes, and other configurations of positioning device 108. With the information of the reference points determined, electronic computing device 106 may then map the chosen hair style to specific locations on the head of user 102 so that the hair length needed to create the chosen hair style is now defined based on location on user's 102 head. Electronic computing device 106 may now direct user 102 to engage hair cutting device 200 to specific locations on user's 102 head, to engage the cutter head of hair cutting device 200 into user's 102 hair, and to pull hair cutting device 200 substantially away from user's 102 head so that hair is extended from the specific location.

Alternatively, electronic computing device 106 may allow user 102 to select any location on their scalp to begin, measure that position, and determine the length of hair needed specific to that location for subsequent cutting. While user 102 extends their hair for cutting, positioning device 108 may continue to monitor the position and orientation of hair cutting device 200 to ensure that user 102 is extending their hair sufficiently so that accurate cutting may take place. In the event that user 102 is not suitably extending the hair in the cutter head of hair cutting device properly, automated hair cutting system 100 may perform computations to correct for errors that would otherwise occur, or automated hair cutting system 100 may alert user 102 to try again. As user 102 extends their hair engaged in hair cutting device 200, electronic computing device 106 may monitor the distance of the cutter head 202 of hair cutting device 200 from the head of user 102 and enable cutting action when the hair of user 102 specific to that location is at a substantially correct length for a specific chosen hair style and length that was previously selected so that hair in the cutter head 202 of hair cutting device 200 is cut substantially to a correct length. Once the hair specific to that location has been cut, electronic computing device 106 again disables cutting action of hair cutting device 200 and directs user 102 to engage hair in another location. Through repeated selection, engagement, extension, and cutting of hair, user's 102 hair is cut to fit the chosen style and length. It is noted that electronic computing device 106 may also direct user 102 to roll their head and use their free hand (the one not being used to hold hair cutting device 200) to most conveniently keep loose hair away from the cutting operation and avoid inadvertently cutting hair that should be kept longer for the desired style and hair length. Since positioning device 108 is affixed to the face of user 108, a key benefit of the system and method is that user 102 is free to move their head in the course of a haircut without compromising positioning or orientation information of hair cutting device 200 relative to positioning device 108.

The process of repeated selection, engagement, extension, and cutting of hair, as described above, offers benefit that hair cutting device 200 need not continuously operate its cutter head. That is, the cutter head may be kept idle during the selection, engagement, and extension of hair and the cutter head need only be actuated to cut hair at times when the position of hair cutting device 200 is beneficial for cutting specific hair at substantially desired lengths. The ability to only operate the cutter head of hair cutting device 200 at times when hair cutting device 200 is properly positioned to cut specific hair allows energy consumption, noise levels, and cutter head wear to all be reduced.

It is very common for hair cutting professionals to measure hair length with their fingers or using a comb or scissors handle as a reference. As a hair cutting professional works across the head of a person, they alter the length of cut to create the style they plan to achieve. Automated hair cutting system 100 works in a way very similar to how human barbers have cut hair for a very long time. It is also possible for automated hair cutting system 100 to operate in different ways. For example, if a user 102 is shaving the back of their neck with hair cutting device 200, automated hair cutting system 100 may prompt them on how to position hair cutting device 200 and what direction to move it. From there, automated hair cutting system 100 may enable the cutter head of hair cutting device 200 as user 102 properly moves hair cutting device 200 and may disable the cutter head of hair cutting device 200 if user 102 moves it incorrectly. In this way, automated hair cutting system 100 ensures that user 102 cuts their hair properly while allowing hair cutting device 200 to be moved smoothly across the back of their neck or other regions of their scalp where a shaving or other hair cutting technique benefits from smooth motion of hair cutting device 200. Still other modes of operation of automated hair cutting system 100 are possible. As an additional example, consider the well-known "flat top" men's hair style. In this style, hair across the top of a man's head is cut to be as flat as possible, without regard to the specific length of hair for each specific region of the man's scalp. For such a hair style, automated hair cutting system 100 may actuate the cutter head of hair cutting device 200 to cut hair when it has been collected and extended to the right point to substantially create a flat top instead of with regard to the precise length of hair for each scalp region.

Since hair cutting device 200 has a cutter head of a significant width, it is possible for hair cutting device 200 to have hair in the cutter head that should be cut at different lengths for any given operation (the operation as noted above of selecting a location, engaging some hair, extending the hair, and cutting it to a substantially correct length). In such cases, electronic computing device 106 may direct hair cutting device 200 to cut the hair in the cutter head only when all hair in the cutter head has been extended so that it is all at either a correct length for cutting or at a longer than needed length. In this way, additional cycles of selecting, engaging, extending, and cutting may be used to further reduce the length of hair that was previously cut longer than desired, but no hair is substantially ever cut too short. This form of operation is important especially for locations on the head of a user 102 where the surface of the user's 102 scalp curves rapidly, or for hair styles in which hair length changes rapidly from one location to another. In FIG. 5C, an embodiment of a cutter head capable of cutting subsets of hair contained in it at different times is shown. Such a cutter head allows embodiments of automated hair cutting system 100 to cut specific hair collected in hair cutting device 200 at specific times, providing benefit in dealing with the situation as described in this paragraph. It is also possible for automated hair cutting system 100 to provide additional guidance or instructions to user 102 to control hair cutting device 200 so that most of the hair contained in cutter head of hair cutting device 200 for a specific operation may be suitably cut at the same time to the length needed. In this way, a user 102 who may operate automated hair cutting system 100 more skillfully may be able to produce an accurate haircut in fewer operations than a user 102 who uses automated hair cutting system 100 substantially without such additional guidance or instructions or who disregards such additional guidance or instructions.

Once user 102 has completed cutting their hair in the fashion described and possibly combed it to exhibit the desired style, a camera on electronic computing device 106 or other camera may be used to collect images of user's 102 hair. These may be shown to user 102 and user 102 may direct electronic computing device 106 that they desire some modification to their hair. For example, user 102 may desire slightly shorter hair above their eyebrows (shorter bangs), a slightly higher collar line in back, or other features. Once user 102 has selected modifications, electronic computing device 106 may again direct user 102 to cut their hair in a manner similar to that previously described to achieve the desired effect. A camera on electronic computing device 106 or other camera may also monitor user 102 through the course of their haircut to ensure that user 102 is operating automated hair cutting system 100 properly and is achieving acceptable results. In such a case, electronic computing device 106 may process images from such a camera or cameras and determine if user 102 should be provided with additional guidance as they cut their hair.

Before the hair cutting process is completed, electronic computing device 106 may ask user 102 if they would like to store some or all of the information about the size and shape of their head, reference point information regarding the location of their ears, eyebrows, etc., their preferred styles, the specific style they chose for this just-completed haircut and perhaps the modifications to that style that were ultimately selected, or other information. If user 102 so desires, this and other information may be stored for future use either directly in electronic computing device 106, or possibly in a network server, cloud computing element, or other device or computing element.

It is noted that each time a user 102 makes use of automated hair cutting system 100, positioning device 108 may be positioned to a slightly different position on their face. Additionally, positioning device 108 may be of a slightly different shape if it was folded (see the embodiments of FIG. 6B and FIG. 7D for reference) for storage or was slightly deformed, bent, or modified since its prior use. In such cases, automated hair cutting system 100 may need to ask user 102 to re-enter the reference point information noted above so that it may properly fit a desired hair style to the head of user 102. Also, prior to cutting features in a user's 102 hair that demand very precise alignment, such as cutting around the ears or ensuring a feature is precisely aligned to a part of a user's 102 face, automated hair cutting system 100 may prompt user 102 to touch and reestablish some reference points specific to the operation about to be undertaken, ensuring substantially precise alignment. In some cases and with some embodiments, if automated hair cutting device 100 has stored information regarding reference points, the size and shape of a user's head, and possibly other information for user 102 from prior use of automated hair cutting system 100, automated hair cutting system 100 may be able to account for changes in precise positioning and shape of positioning device 108 with fewer reference points entered than may otherwise be required.

The display function and computational functions of electronic computing device 106 may be embodied into positioning device 108 or even into hair cutting device 200. Alternate embodiments of automated hair cutting system 100 may also include electronic displays, touchscreens, keyboards, or similar human interface functions. In certain embodiments, instructions, queues, information, and directions to the user 102 from electronic computing device 106 (or as noted other devices in the system whether electronic computing device 106 is present or not) may be delivered visually on electronic displays, with audible signals, with indicator lights, with haptic signaling, or through other techniques.

In other embodiments, a robotic arm under automated control could either grip hair cutting device 200 or be otherwise fitted with a cutter head so that it may directly cut the hair of user 102. Further robotic arms could also be applied to comb hair or position it for cutting. In such a fashion, a robotic system could provide automated hair cutting services.

In alternate embodiments automated hair cutting system 100 may have multiple modes of operation and may provide different commands, guidance or information depending on whether user 102 is using automated hair cutting system 100 to cut their own hair, if another person is using automated hair cutting system 100 to cut a user's 102 hair, or whether automated hair cutting system includes other elements such as Internet access (which would allow additional modes of operation, instructions, etc. to be downloaded). The information provided by automated hair cutting system 100 in the course of a haircut may also be varied depending on the skill level of the person operating it and the type of haircut being provided. For example, novice users of automated hair cutting system 100 may desire more complete guidance especially if they are attempting a complex or challenging hair style.

Those skilled in the art will recognize that the teachings of the system and method may be applied to create robotic or otherwise automated systems for a wide variety of uses where a wide variety of tools (such as cutting devices, grinders, polishers, material dispensing devices, imagers, video cameras, and other possible tools) may be beneficially tracked or monitored relative to another structure, such as a positioning device, so that those tools may be applied to objects with known position and/or orientation relative to such a structure to achieve desired results. A key benefit of the system and method is the ability to accommodate changes in such objects so that they do not need to be substantially identical (as is normally the case for many modern manufacturing or other such systems). As an example, such an automated system may allow a person holding a device or tool to substantially precisely locate it by hand for the application of makeup, hair dye, hair tints, hair highlights, cosmetic surgery, and many other possible functions. And those skilled in the art will further recognize that the teachings of the system and method may be applied to fabrication of mechanical devices, formation of sculpture, fabrication of physical models with modeling clay or other materials, operations such as cutting, grinding, ablating, polishing, clamping, hammering, puncturing, drilling, mixing, painting, coating, imaging, illuminating, robotic microsurgery, eye surgery, drug delivery, dental work, dental surgery, cutting tools, machine tools, and in wide variety of other applications.

Figure 2:
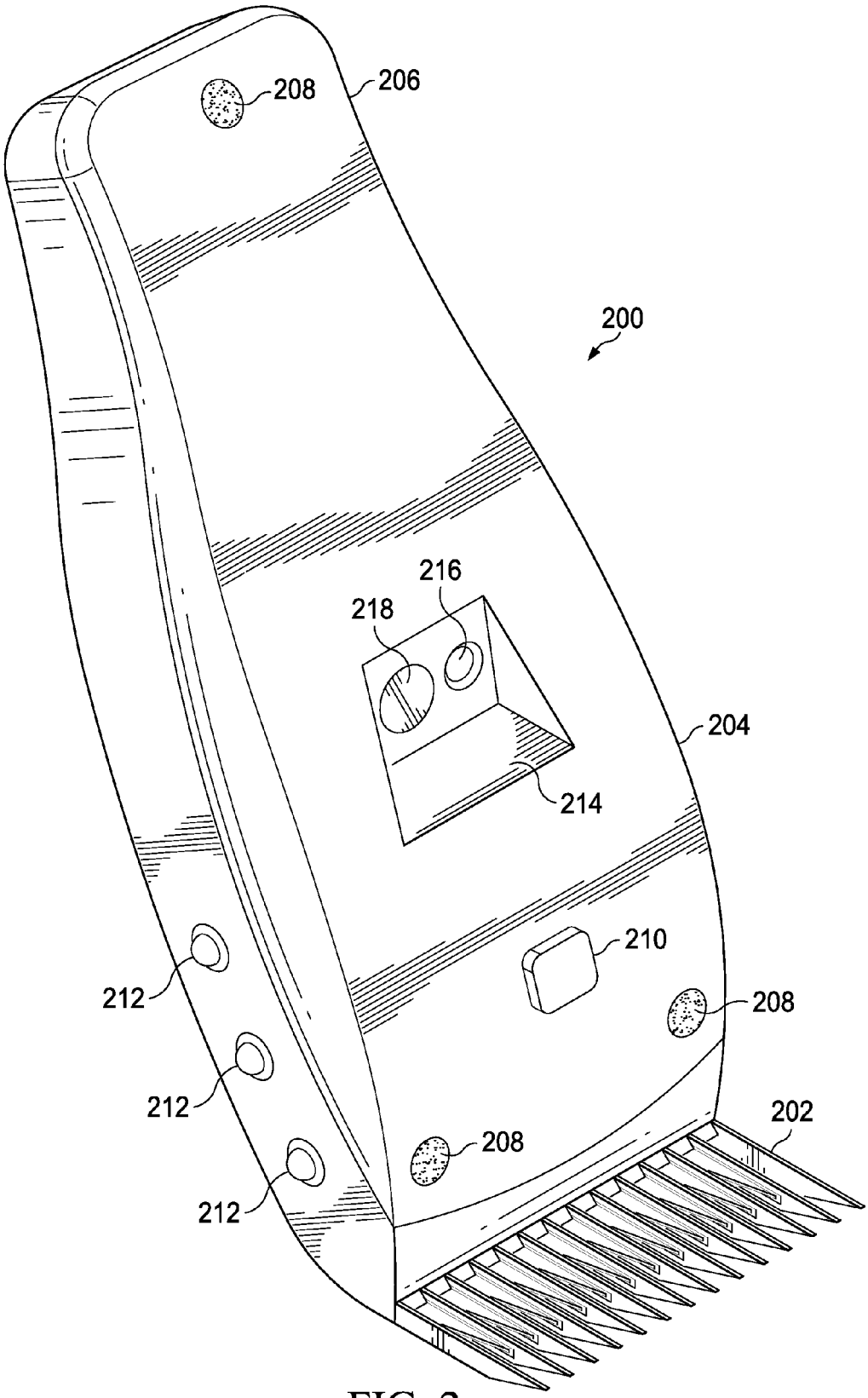
FIG. 2 is an illustration of one embodiment of a hair cutting device having a straight handle and including some features suitable for use in an automated hair cutting system.

FIG. 2 is an illustration of an embodiment of hair cutting device 200 including handle 206, body 204, cutter head 202, sensors 208, accelerometer 210, indicator lights 212, recessed region 214, camera 216 and illumination source 218. Body 204 and handle 206 may contain operation and control electronics, batteries, power electronics, a motor to drive cutter head 202, and other functions. Cutter head 202 may be typical of hair cutter heads found on commonly available hair clippers, trimmers, shavers, or other devices, or may be of special construction for beneficial use in an automated hair cutting system 100. Cutter head 202 may be configured so that it is removable from hair cutting device 200 for cleaning or replacement. Certain embodiments may employ interchangeable cutter heads such that one cutter head may be designed to cut longer hair and it could be interchanged with a trimming cutter head that could be used for detailed trimming, shaving or other functions. Indicator lights 212 may be of various colors, sizes, and locations and may be visible to user 102 in the course of a haircut especially if viewed into a mirror in front of user 102 in the course of a haircut. Indicator lights may help to signal a user on how best to orient, position, and move hair cutting device 200 for substantially better or faster results. Hair cutting device 200 may also contain audible speakers, buzzers, bells, chimes, haptic devices, displays, and other devices to help guide, signal, or provide information to user 102. Indicator lights 212 and audible speakers, buzzers, bells, chimes, haptic devices, displays, and other devices to help guide, signal, or provide information to user 102 on hair cutting device 200 may operate in conjunction with information that user 102 may receive from electronic computing device 106 or from positioning device 108.

Accelerometer 210 may be monitored by hair cutting device 200 to determine its position and orientation and to ensure that it has not been suddenly jerked or rapidly moved before cutter head 202 is enabled to cut the hair it contains. In this way, hair may not be incorrectly cut if sudden user 102 motions exceed the ability of automated hair cutting system 100 to sufficiently determine position and orientation. Hair cutting device 200 may also contain a gyroscope or other position or orientation monitoring sensors and electronics to ensure hair is only cut when it should be and to determine the position and orientation of hair cutting device 200. Accelerometer 210 is shown on the surface of hair cutting device 200 for clarity, but accelerometer 210, gyroscopes, and other possible sensors may be contained inside body 204 and may not be visible on the outside of hair cutting device 200.

The embodiment of hair cutting device 200 shown in FIG. 2 includes three sensors 208 that are operable, as shown in FIG. 1, with the first positioning interface 110, second positioning interface 112, third positioning interface 114, and fourth positioning interface 116 to determine the position and orientation of hair cutting device 200 relative to positioning device 108 as already described. These three sensors 208 as embodied in FIG. 2 are shown at the end of handle 206 and in body 204 near each end of cutter head 202. Such placement of sensors 208 as far from each other as reasonably possible on hair cutting device 200 may be beneficial in providing accurate information about the precise location and orientation of hair cutting device 200. Alternate embodiments may employ alternative placement of sensors 208, for example, placing sensors 208 to avoid obstruction by arms or hands of a user 102 or other people. Other embodiments may place sensors 208 in still other locations and may even place sensors 208 on posts, supports, or other features that adjoin body 204, handle 206, or other elements of hair cutting device 200 and allow sensors 208 to be located beneficially. Having accurate information regarding the orientation of hair cutting device 200 and the location of sensors 208, an accurate determination of the position of cutter head 202 is possible.

Depending on the types of signals used for first positioning interface 110, second positioning interface 112, third positioning interface 114, and fourth positioning interface 116 shown in FIG. 1, sensors 208 may include antennas, microphones, light sensors, infrared sensors, or other types of sensors. Certain embodiments may use transmitters in place of sensors 208 on hair cutting device 200 and sensors on positioning device 108 with similar effect and with signals simply propagating from hair cutting device 200 to positioning device 108 instead of in the other direction. While three sensors 208 are shown in the embodiment of FIG. 2, any number of sensors 208 may be applied in various embodiments. A single sensor 208, for example, may be used in conjunction with accelerometer 210 and possibly with additional gyroscopes or other sensors to achieve good results. And embodiments with two, three, four, or more sensors 208 may provide benefit in offering robust results and accurate positioning and orientation information potentially in the face of blocked signals, multipath or other detrimental aspects of signal interfaces as described above.

Some embodiments of hair cutting device 200 may include a recessed region 214, as shown in FIG. 2, containing a camera 216 and possibly also an illumination source 218. Alternative embodiments may include other physical features to house camera 216 or illumination source 218 such as additional housings or fittings. In certain embodiments employing a recessed camera 216 or illumination source 218, the surface of hair cutting device 200 is kept substantially free of obstructions. Camera 216 may be employed to observe features of the head, face, and hair of a user including reference points that may especially be used to determine locations on a user's scalp or face, to observe features of a positioning device, or to observe other things of benefit in the operation of automated hair cutting system 100. An illumination source 218, may provide illumination to augment operation of camera 216 and may also provide colored light or structured light to augment the ability of automated hair cutting system 100 to analyze images provided by camera 216. Structured light is a well-known concept and will not be discussed in detail here. For purposes of this disclosure, "structured light" is defined as one or more beams of light (incoherent or coherent) that are shaped or arranged relative to one another to form a defined pattern (such as a grid, lines, dots or geometric primitives) and projected so as to illuminate one or more objects to allow distances to specific points on the one or more objects to be ascertained by analyzing images of the one or more objects taken (typically by one or more cameras) under the illumination of the predefined pattern of light. Embodiments of hair cutting device 200 that contain multiple cameras 216, and/or multiple illumination sources 218, and/or multiple sources of structured light, are possible.

Hair cutting device 200 may also include a manual operation mode in which its position is not tracked, but in which it operates as a conventional hair cutter or trimmer such as those commonly available prior to the teaching herein. Such a manual operation mode may be entered through actuation of a switch, button, voice command, or any other type of control. When operating in such a manual operation mode, hair cutting device 200 may continuously actuate cutter head 202 or cutter head 202 may be actuated when a button is pressed, a voice command is given, or through any other type of control.

Figure 3:
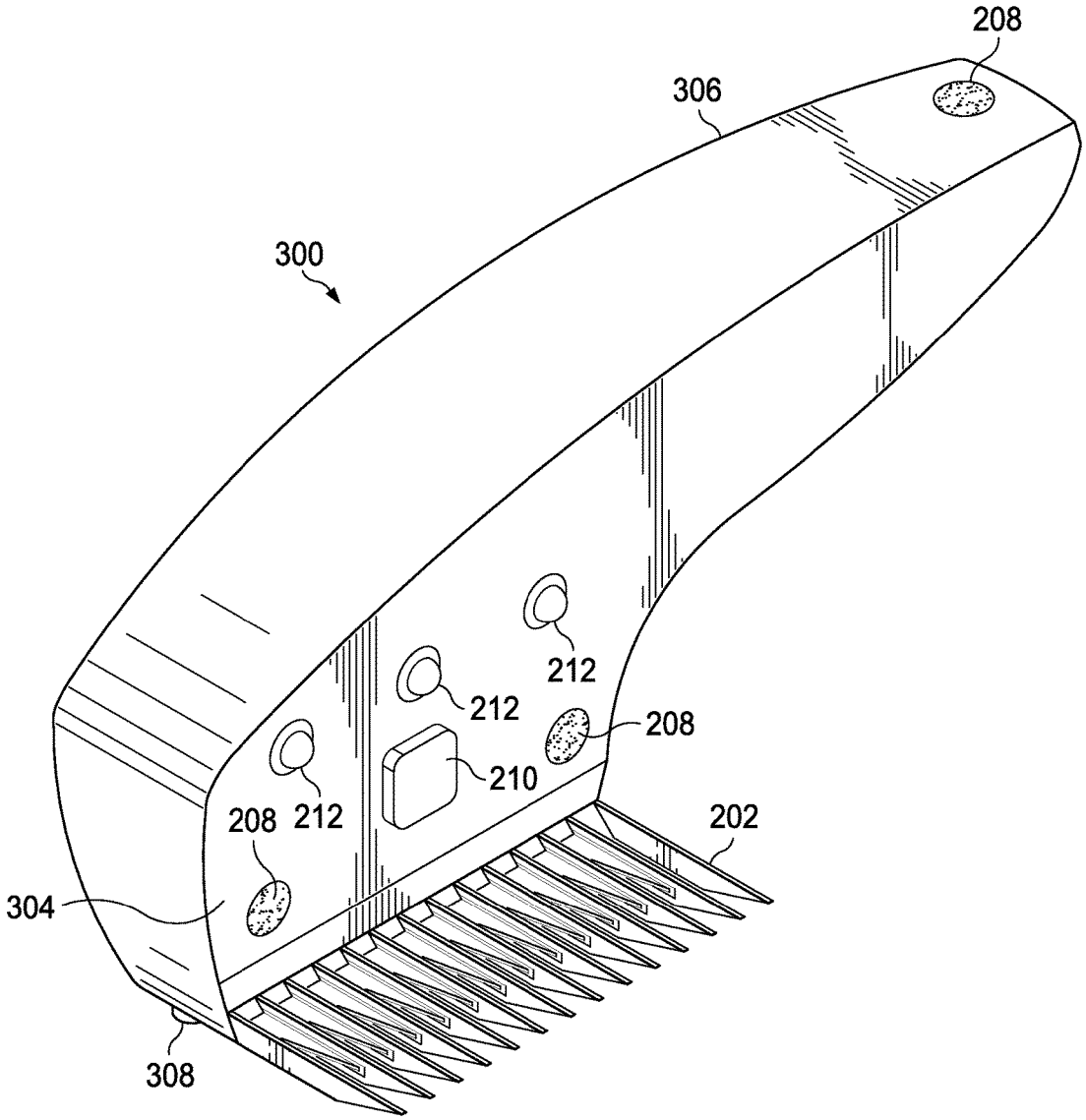
FIG. 3 is an illustration of another embodiment of a hair cutting device having a side handle and including some features suitable for use in an automated hair cutting system.

FIG. 3 shows an additional embodiment of a hair cutting device. In FIG. 3, a hair cutting device with side handle 300 is shown. Hair cutting device with side handle 300 includes sensors 208, indicator lights 212, accelerometer 210, and cutter head 202 that all perform functions substantially equivalent to those described for hair cutting device 200 already described. Hair cutting device with side handle 300 also includes a side handle 306 and body 304 that are shaped in a way that some people may find beneficial or more comfortable for cutting hair. The embodiment of hair cutting device with side handle 300 in FIG. 3 is shown primarily to call attention to the ability to incorporate the system and method into a very wide variety of shapes and styles of hair cutting devices. In addition to the embodiments of hair cutting device 200 and hair cutting device with side handle 300, the system and method may be applied to a very wide variety of hair cutters, clippers, trimmers, shavers, and other devices and may also be applied to devices that shave or trim beards, eyebrows, facial hair, and other hair in addition to hair on a user's 102 scalp as shown in FIG. 1.

In addition to the straight handle 206 of hair cutting device 200 and side handle 306 of hair cutting device with side handle 300, many other embodiments of handles, knobs, levers, supports, and other possible structures may be used so that a person may position a hair cutting device. Handles including pivots so they may be rotated, hinges so they may be tilted, flexible members, telescoping members, adjustable features, rubber grips (or grips made from other materials), contours, or any other enhancements may be applied to embodiments of handles for hair cutting devices.

Hair cutting device with side handle 300 as shown in FIG. 3 may also include touch sensor 308 on the portion of body 304 that may contact user's 102 scalp when hair cutting device with side handle 300 is operated. Touch sensor 308 may be a simple switch, electronic touch sensor, or other contact sensor that signals to hair cutting device with side handle 300 that it has contacted user's 102 scalp, so that hair cutting device with side handle 300 may determine and record its position and orientation. In this way, hair cutting device with side handle 300 may substantially precisely determine the location of user's 102 scalp and compare that on an ongoing basis to where computation from previously determined reference points as described with regard to FIG. 1 indicated user's 102 scalp is expected to be. In this way, automated hair cutting system 100 may monitor its operation and determine if it is sufficiently accurately determining position and orientation of hair cutting device with side handle 300. If user 102, for example, inadvertently bumps, moves, or otherwise disturbs positioning device 108 so that the relative position of positioning device 108 is changed with regard to user's 102 hair, hair cutting device with side handle 300 may detect this as described, stop cutting hair, and request the user 102 to reestablish reference points so that automated hair cutting system 100 may ensure accurate hair cutting. Of course, minor errors in scalp position determined when touch sensor 308 signals that it has contacted user's 102 scalp may be ignored or used to calibrate or otherwise improve automated hair cutting system's 100 estimates of the shape and size of user's 102 scalp. Only one touch sensor 308 is shown in the embodiment of FIG. 3, but two or more are possible and they may be positioned along the length of body 304 near cutter head 202 for beneficial effect, or in other beneficial locations. Embodiments where no touch sensor 308 is employed but where accelerometer 210 or positioning information determined from sensors 208 are monitored to determine when user's 102 scalp has been contacted are also possible.

In certain embodiments of automated hair cutting systems 100, touch sensor 308 includes radar, sonar, or other electronic or electro-mechanical system to determine the distance from the bottom surface of cutter head 202 to the scalp of user 102. The distance from the bottom surface of cutter head 202 to the scalp of user 102 may be employed in some embodiments to determine the location or orientation of hair cutting device with side handle 300 and may also be employed to determine when cutter head 202 should be activated to cut hair it contains. Use of a touch sensor 308 is not limited to a hair cutting device with side handle 300, but may be applied to hair cutting device 200, or other possible embodiments of hair cutting devices.

Figure 4:
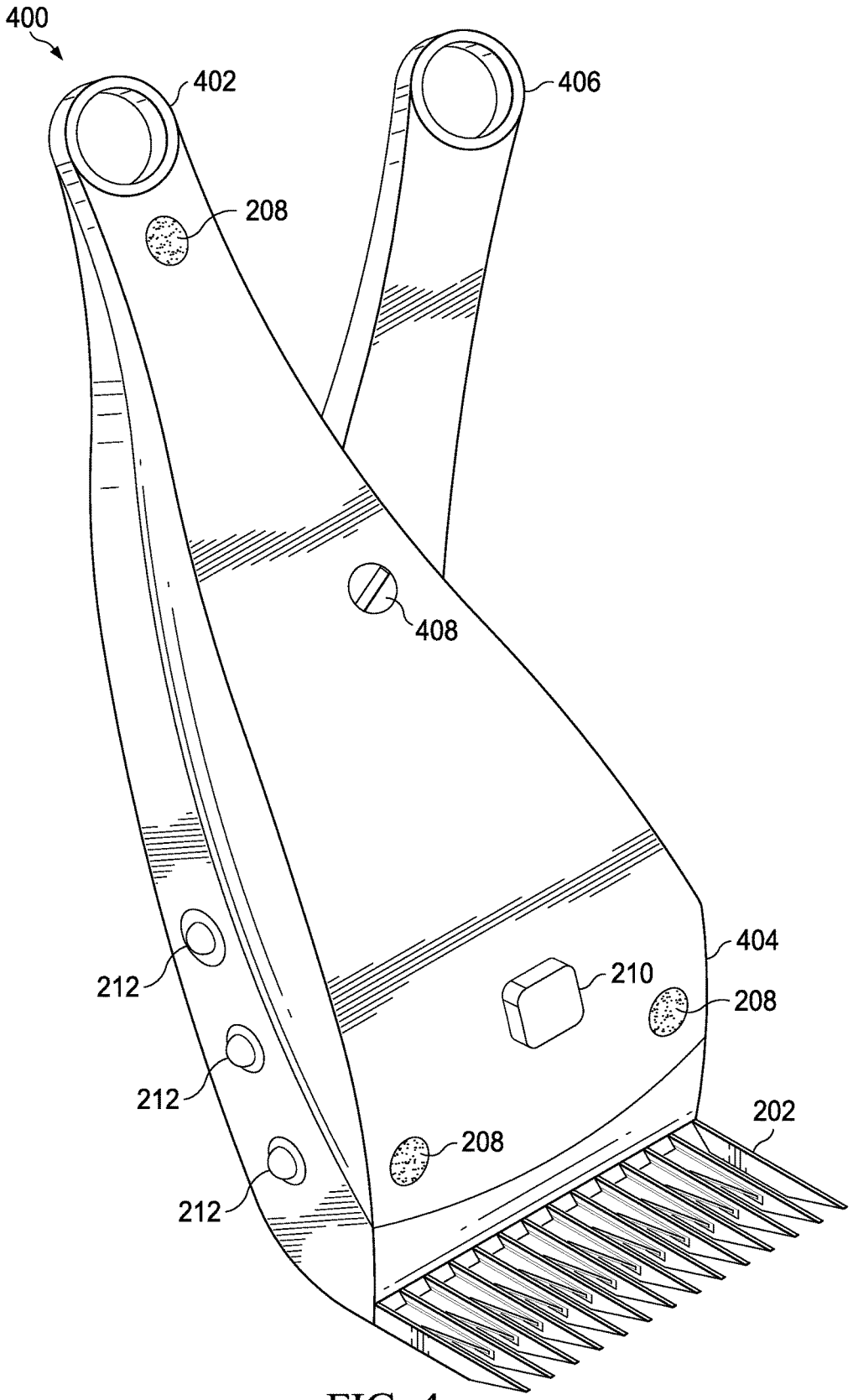
FIG. 4 is an illustration of yet another embodiment of a hair cutting device.

FIG. 4 is an illustration of an embodiment of a manually driven hair cutter 400 that includes sensors 208, accelerometer 210, indicator lights 212, and cutter head 202 that perform similar functions to those of hair cutting device 200. Manually driven hair cutter 400 also includes fixed handle 402, pivot 408, body 404, and movable handle 406. Fixed handle 402 and movable handle 406 are similar to handles on a pair of scissors, and motion from moving the moveable handle 406 could be transferred to cutter head 202 to actuate cutter head 202 and cut hair it may contain. Since some embodiments of the system and method involve cutting hair at substantially precise times so that hair is cut to substantially precise lengths, it is also possible to store energy from motion of movable handle 406 in a spring or other energy storage device and to release that energy through electronic controls to actuate cutter head 202 at substantially precise points in time. In this way, moveable handle 406 may cock a spring or other mechanism or device and the associated energy may be released under control from electronics inside manually driven hair cutter 400 or from signals received from electronic computing device 106, positioning device 108, or from other elements that may be present in some embodiments. It is noted that while moveable handle 406 may be used to provide some of the energy needed to operate manually driven hair cutter 400, that manually driven hair cutter 400 may also receive energy from wired connections, batteries, or other or combinations of energy supplying or energy storage elements. One possible embodiment would be for the cutter head 202 on manually driven hair cutter 400 to be driven with energy from motion of moveable handle 406 and for other elements of manually driven hair cutter 400 to be powered from batteries or a wired or wireless power connection.

In addition to storing energy from motion of moveable handle 406 in a cocked spring or other element, it is also possible for moveable handle 406 to directly actuate cutter head 202 so that cutter head 202 cuts the hair in it directly when handle 406 is moved (much as a scissors cuts items in its blades when the handles are moved). In such an embodiment, the user 102 may be signaled by automated hair cutting system 100 as to when moveable handle 406 should be moved. Such a signal may be audible, haptic, visual, or through other techniques. Several alternative embodiments for a manually driven hair cutter 400 are possible including a very wide variety of handles, levers, knobs, etc. for how a user may manually drive a hair cutter.

Figure 5A:
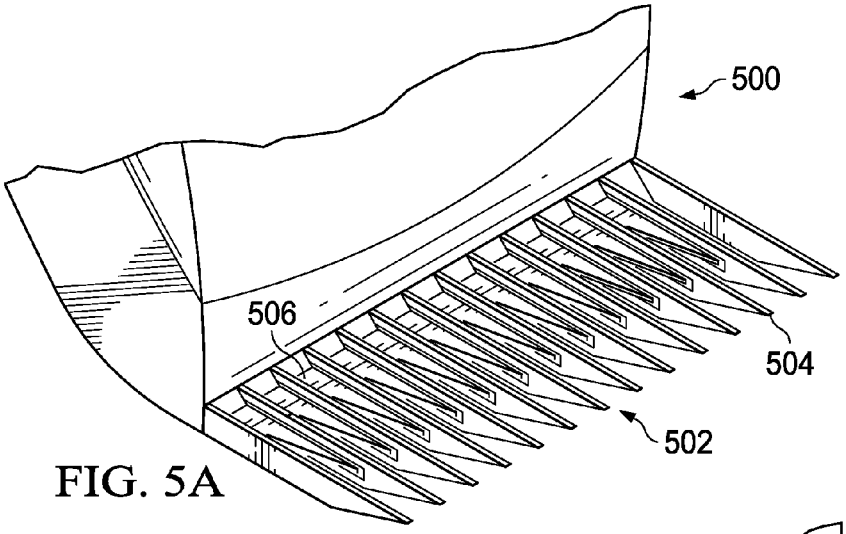
FIG. 5A is an illustration of one embodiment of a cutter head for a hair cutting device.

FIG. 5A shows a cutter head 500 that may be employed for cutter head 202 shown in FIGS. 2-4. Front edge of cutter head 502 is formed from cutter head comb teeth 504, and cutter head 500 operates when blade 506 is actuated back and forth through the openings shown in cutter head comb teeth 504. Blade 506 may be actuated with a linear actuator, rotary motor, piezo motor, magnetic motor, or other types of motors or actuators. When blade 506 actuates back and forth any hair sufficiently inside cutter head comb teeth 504 that it contacts blade 506 may be cut. Cutter heads formed from adjoining cutting blades that move back and forth, rotary cutters, laser cutting devices, and other types of cutters may be adapted to work with the system and method. Cutter head 500 may be employed such that contact with a person's hands, a comb, or with other tools for positioning hair does not cause injury or damage. Spacing of comb teeth 504 and other possible design considerations may be taken into account in providing a substantially safe design for cutter head 500 that substantially avoids injury or damage if inadvertent contact is made with it.

Figure 5B:
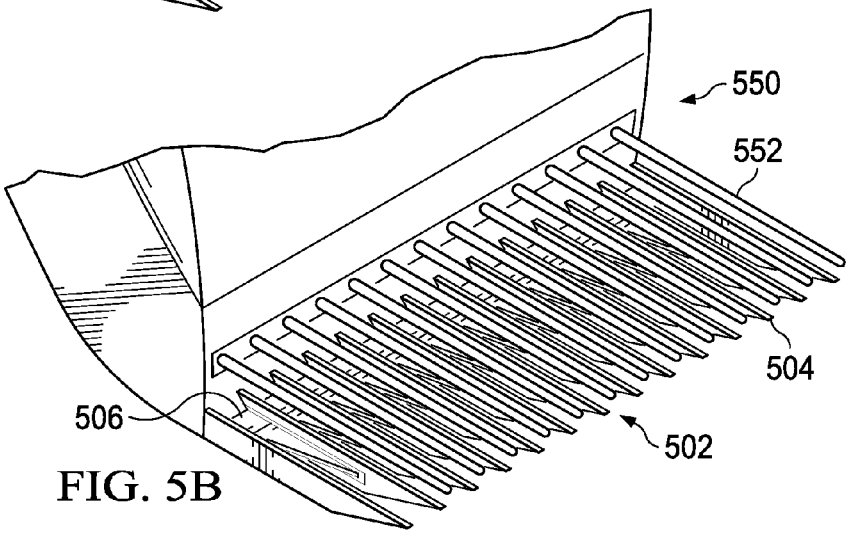
FIG. 5B is an illustration of another embodiment of a cutter head for a hair cutting device having an auxiliary comb.
Figure 5C:
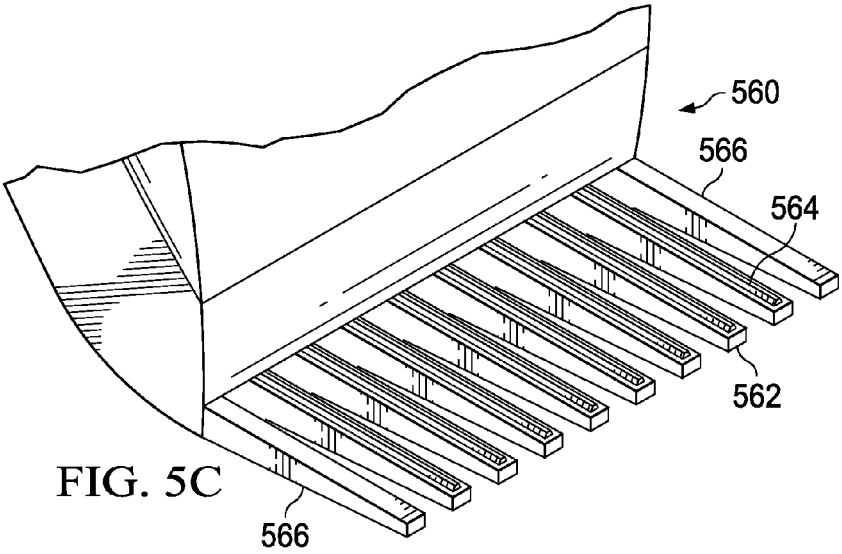
FIG. 5C is an illustration of yet another embodiment of a cutter head having a bottom comb and cutter knives actuated relative to the teeth of the bottom comb.

FIG. 5B shows a cutter head having an auxiliary comb 550. Cutter head with auxiliary comb 550 includes front edge of cutter head 502, cutter head comb teeth 504, and blade 506. These elements perform the same functions as the cutter head 500 shown in FIG. 5A. Cutter head with auxiliary comb 550 also includes auxiliary comb teeth 552 that may be spaced over and above cutter head comb teeth 504 so that auxiliary comb teeth 552 also engage and substantially contact hair collected in cutter head with auxiliary comb 550. Some embodiments of the system and method may employ auxiliary comb teeth 552 to provide additional friction making it easier to control hair in cutter head with auxiliary comb 550 versus other possible types of cutter heads. A user 102, for example, that has curly hair or other types of hair may find that their hair springs free from the cutter head before it can be cut unless auxiliary comb teeth 552 or some other means is used to provide additional friction. Auxiliary comb teeth 552 may be formed from plastics, metals, or other materials and may be textured, serrated, coated, or otherwise finished so that they provide a desirable level of friction to hair collected in cutter head with auxiliary comb 550. In addition, auxiliary comb teeth 552 may be fixed in place above cutter head comb teeth 504, or may be actuated and may serve to grab or latch hair into cutter head with auxiliary comb 550. If auxiliary comb teeth 552 are actuated, they may move together or individually in response to electrical or mechanical mechanisms and may move sideways, up and down, or in other directions. Embodiments in which auxiliary comb teeth 552 may be adjusted to achieve a desired level of friction, interchanged with other embodiments of auxiliary comb teeth to adjust friction, or retracted or removed if no additional friction is desired are also possible. It is also possible that cutter head teeth 504 be specially formed, coated, textured, serrated, or otherwise finished so that they also provide the function of providing sufficient friction for convenient control of hair. Embodiments in which cutter head teeth 504 may be specially formed, coated, textured, serrated, or otherwise finished to provide sufficient friction may be applied whether or not auxiliary comb teeth 552 are present in those embodiments.

The embodiment of cutter head with auxiliary comb 550 shown in FIG. 5B may also offer benefit in gripping hair after it has been cut so that it may be moved to a place suitable for disposal and released. If auxiliary comb teeth 552 are actuated under control from a user 102, under automatic electronic control, or through another control method, some embodiments may allow user 102 to manually (or through voice commands, etc.) signal when to release auxiliary comb teeth 552 so that cut hair is released. Alternative embodiments of hair cutting devices such as hair cutting device 200 shown in FIG. 2 may include the ability to connect a vacuum such that cut hair may be suctioned away. Other embodiments contain features to allow cut hair to be temporarily stored (possibly after grinding it for more compact storage) before it is discarded.

FIG. 5C shows an embodiment of a cutter head with bottom comb 560. Bottom teeth 562 are spaced to allow hair to enter and to be combed in a conventional way (that is, like a common comb is used). Cutter knives 564 are positioned on top of bottom teeth 562 so that they do not interfere with the function of the bottom comb, allowing regions of hair to be engaged and extended. Cutter knives 564 may then be actuated so that they slide over the regions between bottom teeth 562 and cut hair that may be present. Cutter knives 564 may be actuated together as a single element, or some embodiments may allow them to be actuated in groups or to be actuated individually. If cutter knives 564 can be actuated in groups or individually, it is possible for automated hair cutting system 100 to actuate them so that the hair collected between individual bottom teeth 562 is optimally cut, potentially providing improved accuracy versus a cutter head that cuts all the hair collected in it at once. Cutter knives 564 are not shown present on top of end bottom teeth 566, but some embodiments may include them. Putting cutter knives 564 on top of end bottom teeth 566 may not be necessary as cutter knives 564 above adjacent bottom teeth 562 may cut the hair collected near them. It is also possible to eliminate cutter knives 564 from alternate bottom teeth 562 across the entire cutter head with bottom comb 560 if the cutter knives 564 present can actuate in both directions and cut hair in both the adjacent gaps between bottom teeth 562 they adjoin.

Figure 6A:
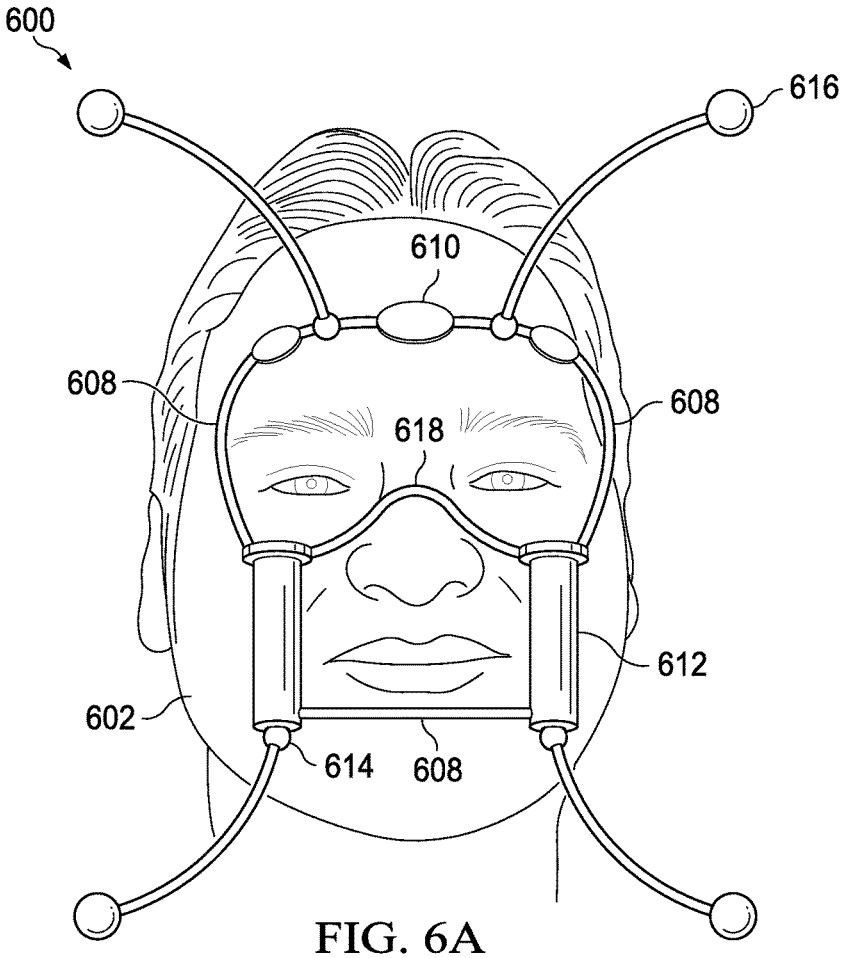
FIG. 6A is an illustration of one embodiment of a positioning device having hinges.

FIG. 6A shows an embodiment of a foldable positioning device 600. Foldable positioning device 600 operates similarly to the embodiment of positioning device 108 shown in FIG. 1 and includes a forehead support 610, a nose support 618, connecting members 608, and four positioning interfaces 616. Foldable positioning device 600 also includes two body housings 612 and four hinges 614. Foldable positioning device 600 is shown affixed to the face of a user 602. Communications and control electronics, batteries, buttons, speakers, microphones, wireless interfaces, wired interfaces, and other functions may be incorporated in body housings 612. Hinges 614 allow foldable positioning device 600 to be folded so that it can be compactly stored or transported. Foldable positioning device may be fabricated from metals, plastics, woods, other suitable materials and combinations of materials.

Figure 6B:
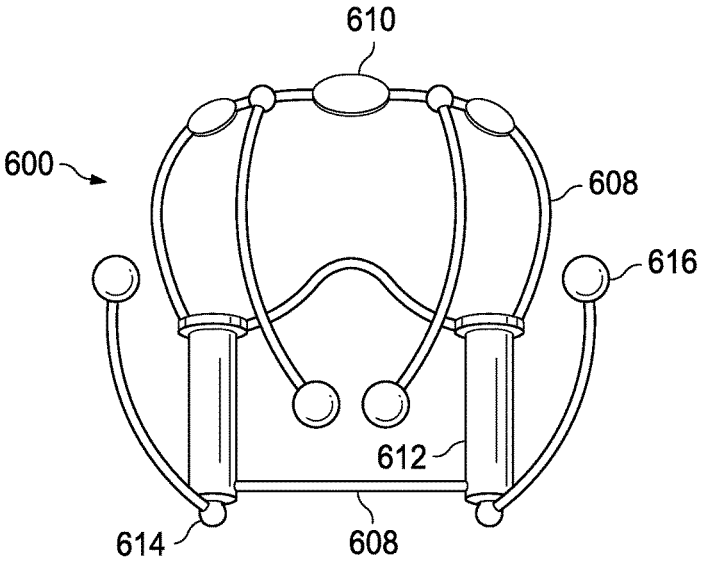
FIG. 6B is an alternate illustration of the embodiment of FIG. 6A having been folded.

FIG. 6B shows foldable positioning device 600 from FIG. 6A after it has been folded at hinges 614 for compact storage. It is noted that in addition to hinges 614 as shown, foldable positioning device 600 may include flexible members, telescoping shafts, and other elements to allow it to be compactly folded. In addition to folding for storage, a positioning device 108 or foldable positioning device 600 may include elements allowing it to be adjusted to fit a range of faces of different possible users. For example, one embodiment of a positioning device 108 or foldable positioning device 600 allows adjustment to properly fit a small face of a child and also a relatively large face of an adult. A positioning device 108 or foldable positioning device 600 may also be configured for specific hair styles (i.e., such that positioning device 108 or foldable positioning device 600 provides sufficient positioning information for a specific hair style and having less weight, material, space, or is more convenient or cost effective, or provides other additional benefits than it would if it were intended for other hair styles).

Figure 7A:
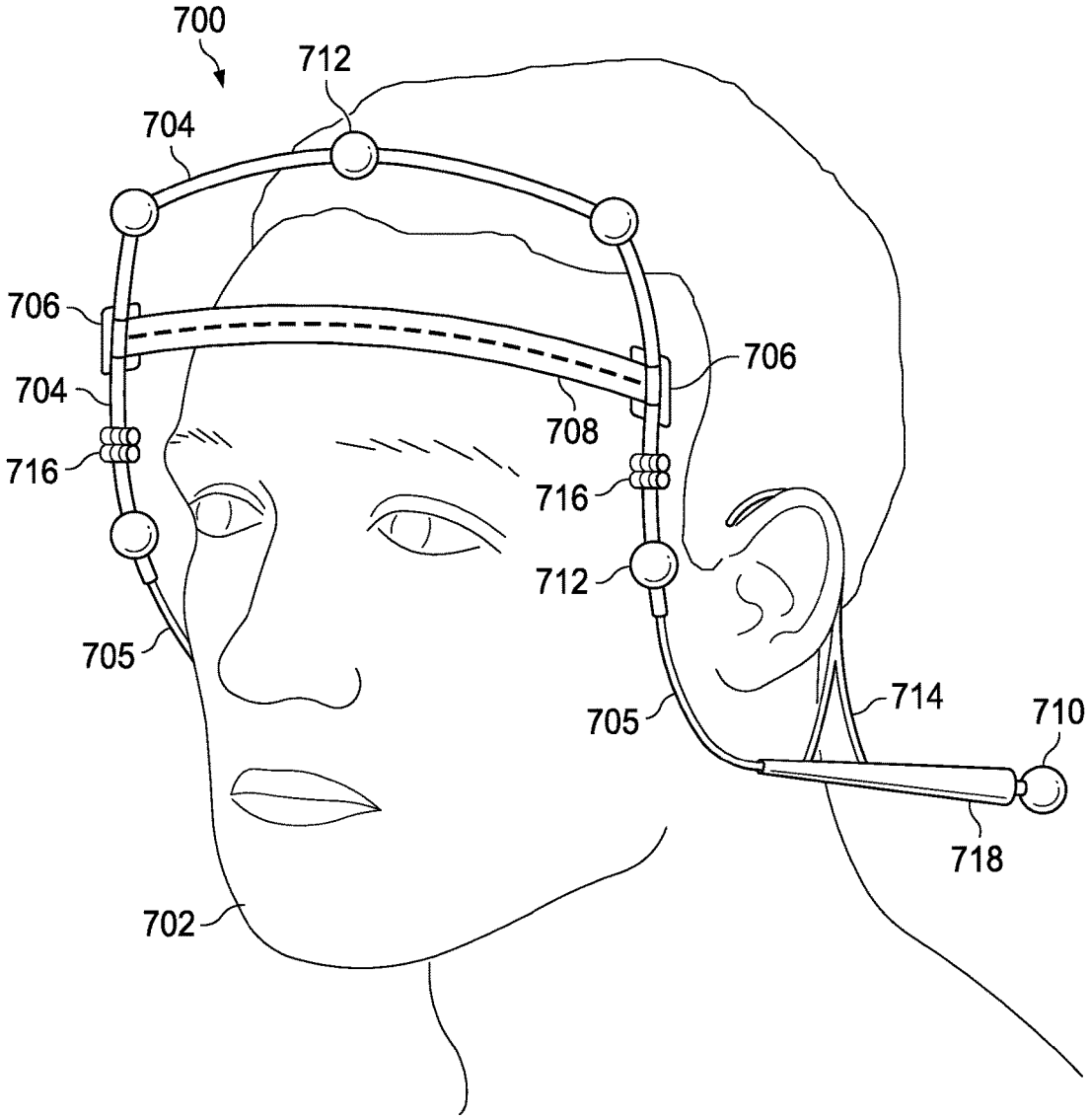
FIG. 7A is an illustration of one embodiment of a positioning device having tubular construction.

FIG. 7A is an illustration of an embodiment of a positioning device with tubular construction 700. Ear supports 714 and a head band 708 support a main tube 704 of positioning device with tubular construction 700 around the face and head of user 702. Band connectors 706 may allow head band 708 to be adjusted in length and in position along main tube 704. Main tube 704 supports positioning interfaces 712 that may operate and function in a fashion similar to those shown in FIG. 1. The embodiment of FIG. 7A has six positioning interfaces 712 visible and a seventh positioning interface blocked from view by the neck of user 702 (end positioning interfaces 710 are also considered positioning interfaces 712 for this count, indeed, end positioning interfaces 710 are only separately numbered to call attention to their specific location). Additional embodiments of positioning device with tubular construction 700 may support larger or smaller numbers of positioning interfaces 712. While positioning interfaces 712 in FIG. 7A are shown as enlarged regions of main tube 704, some embodiments may make use of a main tube 704 large enough that positioning interfaces 712 are fully contained inside it and are not externally visible. In such embodiments, main tube 704 may appear to be smooth and may not show external features where positioning interfaces 712 are present. Ear supports 714 and head band 708 may be adjustable in position along main tube 704, in length, in orientation relative to main tube 704, and in other aspects. Hinges 716 are shown that allow main tube 704 to be folded for storage (this will be explained further with regard to FIG. 7D). Certain embodiments may employ hinges, flexible tubing, telescoping tubing, adjustable screws, springs, elastic materials, fasteners, and other techniques to allow positioning device with tubular construction 700 to be folded or otherwise made compact for storage or adjusted to better fit user 702. End positioning interface 710 and end housing 718 are shown at one end of main tube 704 and a similar end positioning interface and end housing on the other end of main tube 704 are blocked from view by the neck of user 702. End housing 718 and main tube 704 may contain batteries, electronics, computing devices, signal processing devices, and other functions to enable operation of positioning device with tubular construction 700 as a positioning device as described with regard to positioning device 108 of FIG. 1 and other embodiments shown in this patent application. Positioning device with tubular construction 704 may receive power and interface signals from batteries and/or wired or wireless interfaces. End housing 718 may allow some of the heavier elements of positioning interface with tubular construction 700 to be positioned below and behind the ears of user 702 so that they provide balance to positioning interface with tubular construction 700 and provide leverage from ear supports 714 to help keep head band 708 in place against the forehead of user 702. The embodiment of end housing 718 shown in FIG. 7A is shown as a conical structure, but many other shapes and sizes are possible including cubic structures and cylindrical structures. Some embodiments of positioning device with tubular construction 704 may lack end housings 718 as their electronics and other needed elements may be contained entirely inside main tube 704 or in other areas inside or upon positioning device with tubular construction 700.

Positioning device with tubular construction 700 has regions of narrow tubing 705 in which main tube 704 is substantially reduced in diameter. Certain embodiments may employ regions of narrow tubing 705 to allow hair cutting devices to be more easily applied and operated in regions of the face and head of user 702. In FIG. 7A, regions of narrow tubing 705 are shown in areas where positioning device with tubular construction 700 passes in front of the ears of user 702. Other embodiments may employ regions of narrow tubing 705 to allow more precise trimming of sideburns and other features of haircuts just above and in front of the ears of a user 702. Certain embodiments may also include regions of narrow tubing or other features to allow improved convenience in or on other parts of positioning device with tubular construction 700.

Positioning device with tubular construction 700 as embodied in FIG. 7A may be employed to provide a simple and attractive design that is easy to store, clean, and maintain. Positioning device with tubular construction 704 may be constructed from plastics, metals, wood, ceramics, rubber or other materials and may be constructed to be easy to clean and may employ materials that resist the formation of bacteria and germs. Positioning device with tubular construction 700 may be designed to be submersible in water so that it may be easily rinsed clean.

Certain embodiments of positioning device with tubular construction 700 employ an enlarged open region in front of the eyes of user 702 so that user 702 may wear eyeglasses while operating automated hair cutting system 100. While eyeglasses may interfere with cutting hair on some parts of the head of a user 702, some users may prefer to cut some or most of their hair with their eyeglasses on and only remove their eyeglasses to cut those portions of their hair obstructed by their eyeglasses. Alternate embodiments employ a positioning device that allows a user 702 to wear their eyeglasses and also to remove and replace their eyeglasses without disrupting operation of the positioning device. While certain embodiments of positioning devices may be configured to allow operation with eyeglasses in place, positioning device with tubular construction 700, as shown embodied in FIG. 7A, allow for easier access because of the large opening it provides in front of the eyes of user 702.

Main tube 704 and regions of narrow tubing 705 may be composed of flexible materials that may be bent and formed such that positioning device with tubular construction 700 may be properly and comfortably fit to the head of user 702. Alternatively, main tube 704 and regions of narrow tubing 705 may be composed of rigid or semi-rigid materials and may be formed to include smooth curves. Main tube 704 and regions of narrow tubing 705 may also be composed of materials that provide tension or spring function so that positioning device with tubular construction 700 applies an acceptable level of compression against the face of user 702 through ear supports 714 and head band 708 so that they more easily grip the face of user 702. Ear supports 714 and head band 708 may employ coatings, adhesives, paste, tape, texturing, or other techniques to improve their grip to the face of user 702 or improve comfort. Ear supports 714 may also be coated, textured, or otherwise finished so that eyeglasses resting over the top of ear supports 714 may more easily grip ear supports 714. Main tube 704 and regions of narrow tubing 705 may have a circular, square, triangular, hexagonal, or other cross-section. Normally, main tube 704 and regions of narrow tubing 705 will include a hollow center so that wiring, circuitry, electronics, and other elements may be formed or placed inside them. However, embodiments in which main tube 704 and regions of narrow tubing 705 have solid cross-sections without a hollow center are also possible.

Figure 7B:
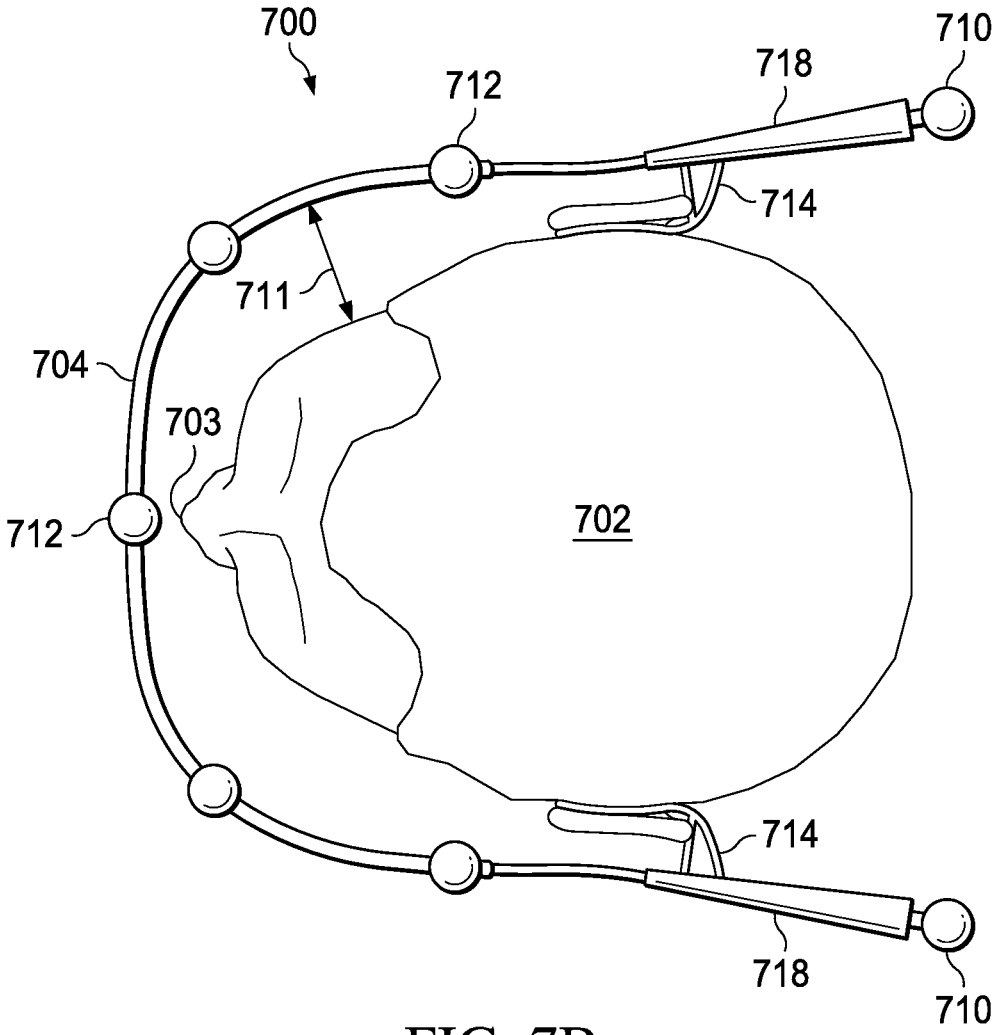
FIG. 7B is a top view of the embodiment of FIG. 7A illustrating spacing of the positioning device relative to the head of the user.

FIG. 7B shows a top view of an embodiment of a positioning device with tubular construction 700. Ear supports 714, end housings 718, end positioning interfaces 710, positioning interfaces 712, and main tube 704 are shown around the head of user 702. The end of the nose 703 of user 702 is also shown in FIG. 7B to avoid any possible confusion regarding the orientation of this top view of user 702. Distance 711 from head 702 to main tube 704 in FIG. 7B is shown to call attention that keeping a gap between the main tube 704 of positioning device with tubular construction 700 and the head of user 702 provides a substantially less obstructed path between positioning interfaces 712 and sensors 208 on hair cutting device 200 (or other embodiments of hair cutting devices) than may be possible if main tube 704 were in close proximity to the head of user 702. Maintaining a distance 711 from head 702 to main tube 704 may also be beneficial as it allows positioning device with tubular construction to be applied and fit to users 702 of different ages and with different sized and shaped heads. Distance 711 may be selected for different embodiments based on multiple factors including size, weight, comfort, and other factors but may generally be in the range of one to several inches. It is also noted that in FIG. 7B, the sections of positioning device with tubular construction 700 behind the ears of user 702 including end housings 718 and end positioning interfaces 710 are oriented slightly outward, away from the back of the head of user 702. In some embodiments, sections of positioning device 700 may be oriented outward behind the ears of user 702, as shown, providing easier access to the back portions of user's 702 head and scalp. Other embodiments employ positioning devices kept partially or fully in close contact with the face and head of user 702.

Figure 7C:
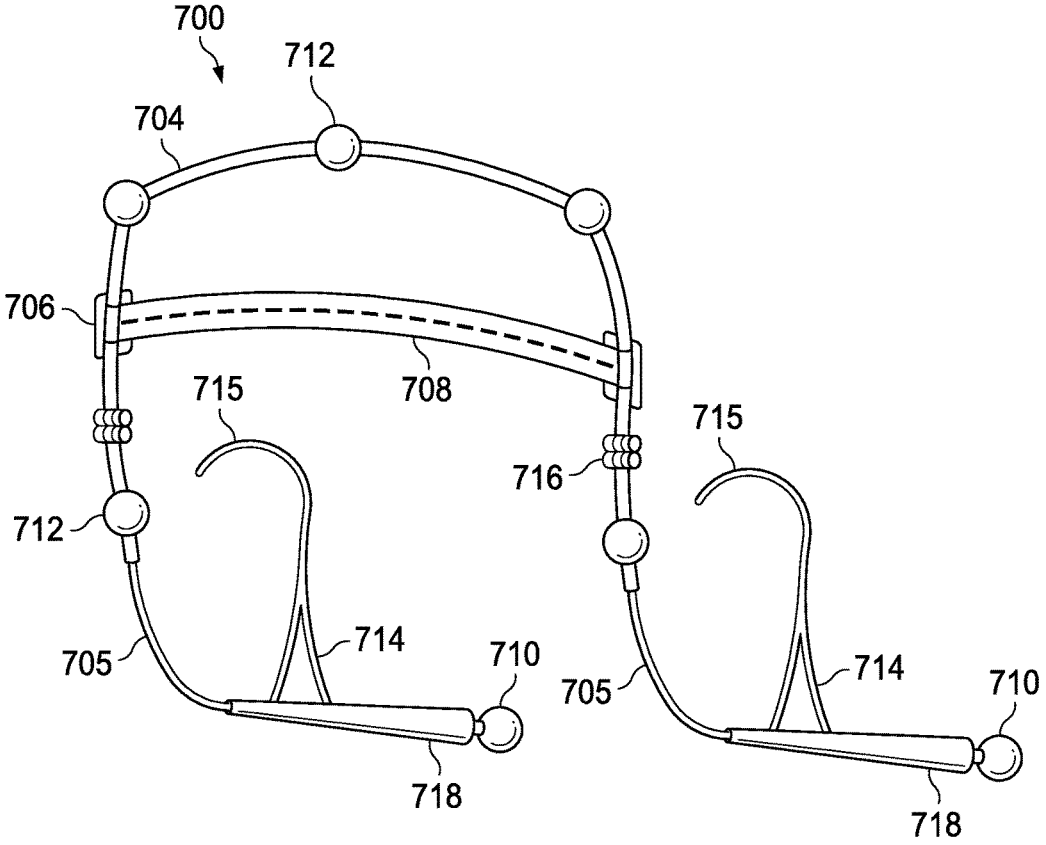
FIG. 7C is an alternate view of the embodiment of FIG. 7A.

FIG. 7C shows positioning device with tubular construction 700 from FIG. 1 in which user 702 is omitted such that an unobstructed view of positioning device with tubular construction 700 is possible. The elements of FIG. 7C are identically numbered to those in FIG. 7A with the addition of ear hooks 715 (ear hooks 715 are not numbered in FIG. 1 as view of them is almost entirely obstructed by the ears of user 702). Ear hooks 715 as shown in the embodiment of FIG. 7C provide support by hooking over the tops of the ears of a user wearing positioning device with tubular construction 700 and also allow some tension to be developed between the back of the ears of a user to the head band 708. In this way, head band 708 may fit the forehead of a user with some tension so that it is less likely to slip. Head band 708 may be formed from or include rubber, plastics, springs, or other elastic materials so that it may maintain tension against the forehead of a user. Head band 708 may also be adjusted in length and in position along main tube 704 using band connectors 706. Ear supports 714 may also be formed from materials that are able to be flexed so that some pressure may be maintained against the back of the ears of a user wearing positioning device with tubular construction 700. Additional embodiments of positioning device with tubular construction 700 are possible in which other support features or techniques are incorporated instead of or in addition to head band 708 and ear supports 714. For example, positioning device with tubular construction may be supported with features that contact the temples, checks, ear lobes, inside the ears, in front of the ears, below the ears, behind the ears, above the ears, eye sockets, nose, mouth, and other regions of the face and head of a user. Ear hooks 715 may be fabricated from metals, plastics, wire, or other materials. Flexible ear hooks 715 made from loops of string, wire, or other materials that partially or fully encircle the ear of a user are also possible.

Figure 7D:
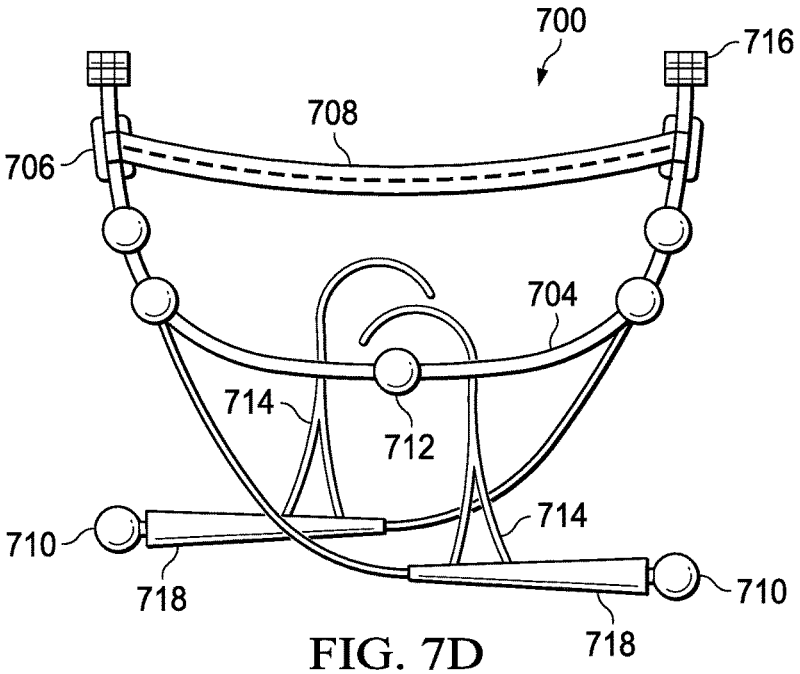
FIG. 7D is an alternate view of the embodiment of FIG. 7A having been folded.

FIG. 7D shows an embodiment of positioning device with tubular construction 700 from FIG. 1 folded at hinges 716 for compact storage. The regions of positioning device with tubular construction 700 near ear supports 714 have been folded across each other and the region of positioning device with tubular construction 700 near head band 708 has been folded downwards. Hinges 716 in the embodiment shown include special construction to allow for both pivoting and folding for the embodiment as shown in FIG. 7D to be possible. Alternate embodiments of positioning device with tubular construction 700 or other possible positioning devices may contain many combinations of hinges, pivots, telescoping elements, ball joints, flexible materials, elastic materials, actuators, and other possible elements to fold or otherwise be re-configured conveniently.

Figure 7E:
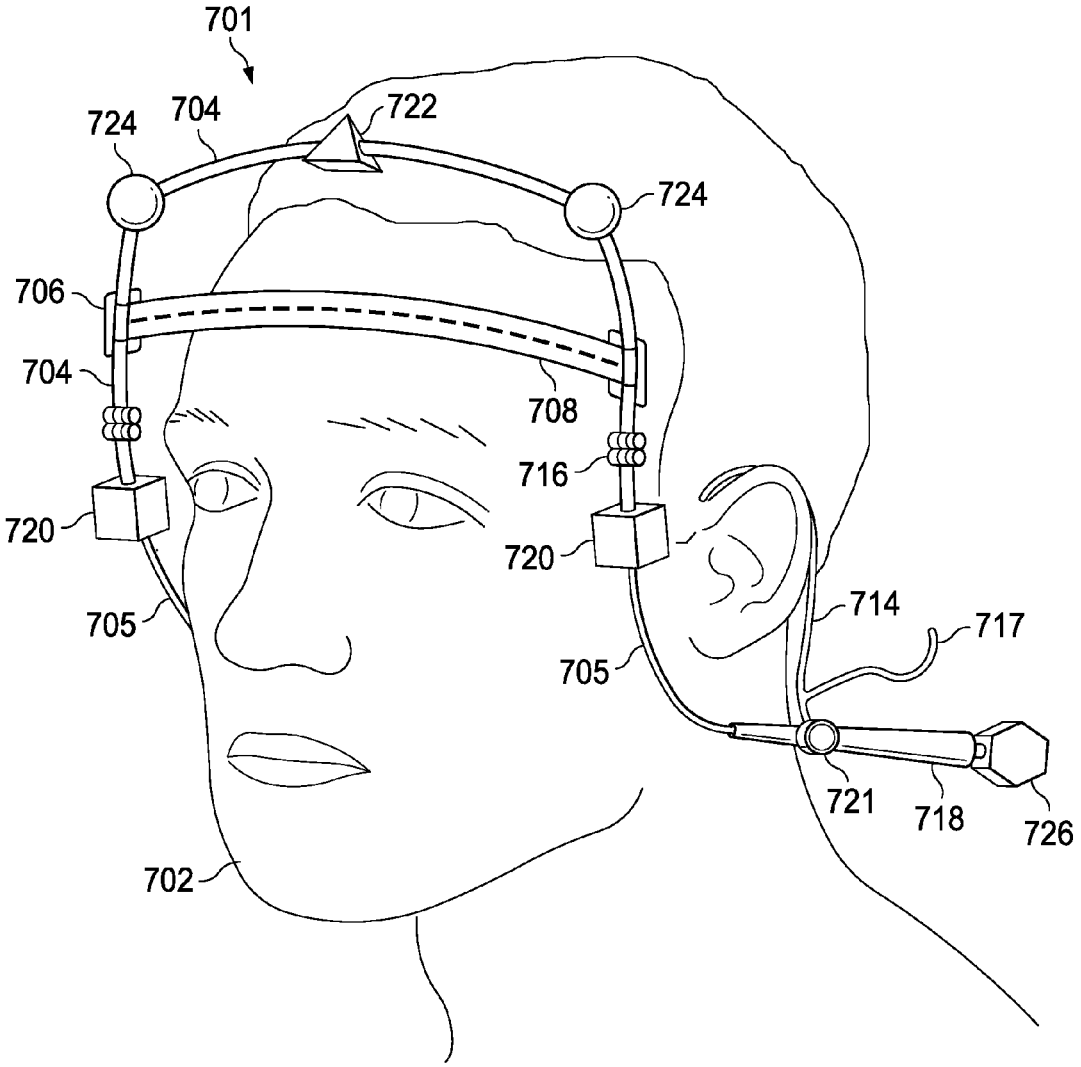
FIG. 7E is an illustration of another embodiment of a positioning device having tubular construction and an ear support.
Figure 7F:
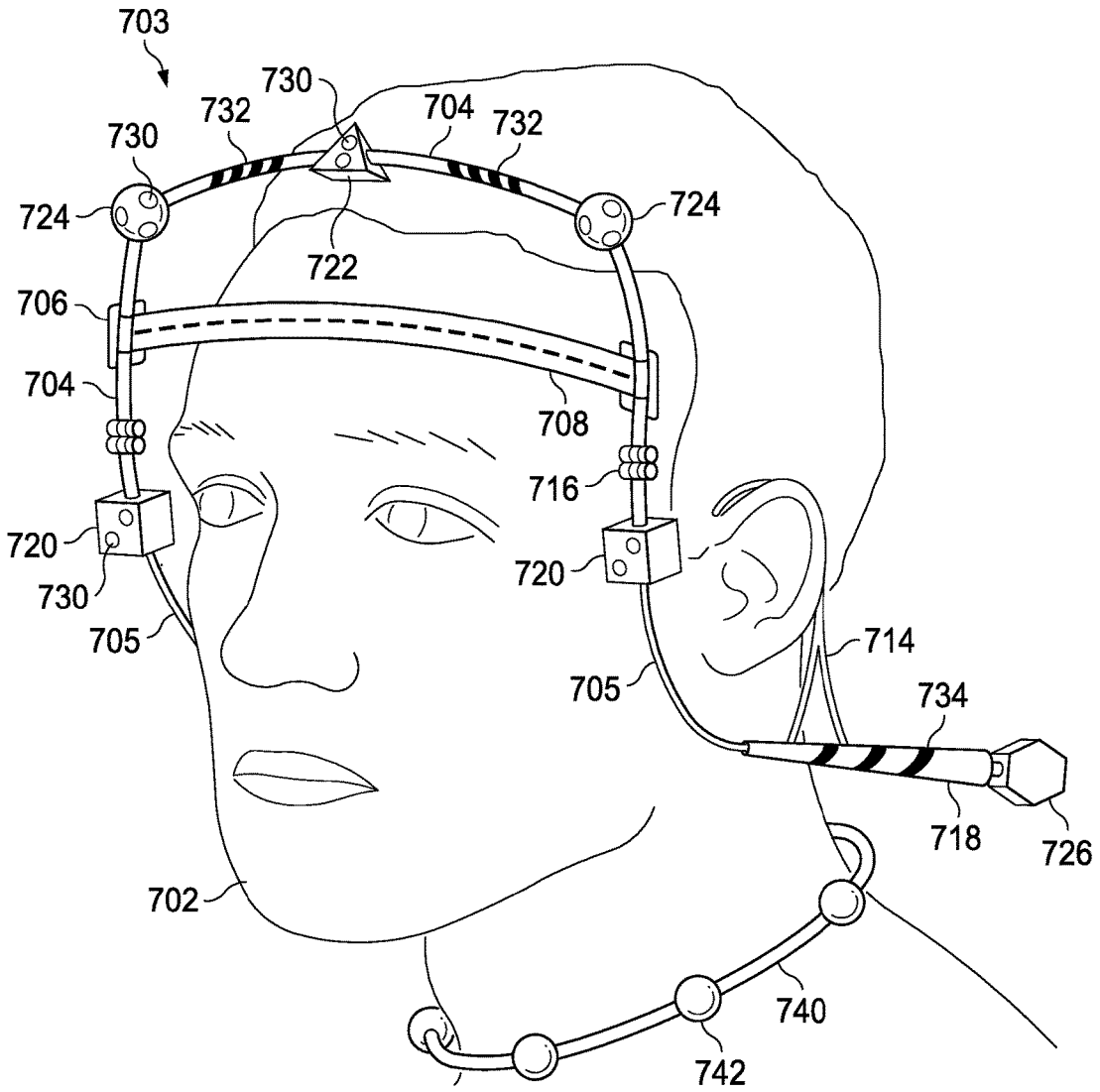
FIG. 7F is an illustration of yet another embodiment of a positioning device having tubular construction.

Before describing FIGS. 7E and 7F, it should be noted that, in addition to observing a positioning device through a camera (with or without structured light), embodiments of positioning structures are possible in which the user may also be "directly" observed. Direct observation of the face or head of a user may be used in conjunction with a positioning device (and in conjunction with accelerometers, gyroscopes, etc.) to compute position and/or orientation of a hair cutting device. It is also possible to have embodiments of positioning structures that do not use a positioning device (as noted in the Detailed Description with reference to FIG. 1) and that determine position and/or orientation only through direct observation of the user (again, with or without structured light and potentially in conjunction with use of accelerometers, gyroscopes, etc.). Cameras may also be used to ensure substantially proper placement of a positioning device on a user's face, and to detect if a positioning device has moved from correct placement. Cameras may be the camera 107 of FIG. 1, a camera or cameras mounted on hair cutting devices such as camera 216 mounted on hair cutting device 200 of FIG. 2, or could be cameras in sensor hubs 904 (FIG. 9), or other cameras.

FIG. 7E is an illustration of an embodiment of a positioning device with easily visible features 701. Ear supports 714, head band 708, band connectors 706, main tube 704, regions of narrow tubing 705, and user 702 are all visible and provide similar functions to like numbered elements in FIG. 7A. However, unlike the embodiment of FIG. 7A, the embodiment of positioning device with easily visible features 701 of FIG. 7E has first visible positioning interface 720, second visible positioning interface 722, third visible positioning interface 724, and end visible positioning interface 726 that are larger and of various shapes versus the smaller spherical positioning interfaces 712 of FIG. 7A. First visible positioning interfaces 720 are cubical, second visible positioning interface 722 is pyramidal, third visible positioning interfaces are spherical, and end visible positioning interfaces 726 are hexagonal. Certain embodiments of positioning devices employ easily visible and distinguishable positioning interfaces (such as first visible positioning interface 720, second visible positioning interface 722, third visible positioning interface 724 and end visible positioning interface 726) and cameras (such as camera 216 on hair cutting device 200, or camera 107 on electronic computing device 106). By observing first visible positioning interface 720, second visible positioning interface 722, third visible positioning interface 724, and end visible positioning interface 726 through a camera and performing analysis with computer vision algorithms, the relative positions of first visible positioning interface 720, second visible positioning interface 722, third visible positioning interface 724, and end visible positioning interface 726 may be easily distinguished and used to make a determination of the position and orientation of the camera relative to positioning device with easily visible features 701. Embodiments employing such a camera allow the calculation of position and orientation of hair cutting device 200 relative to positioning device with easily visible features 701. In alternate embodiments, first visible positioning interface 720, second visible positioning interface 722, third visible positioning interface 724, and end visible positioning interface 726 may also provide the function of positioning interfaces as described in FIG. 1, where signals and propagation delay computations for are employed for determining position or orientation. Certain embodiments employ positioning interfaces as visible features that may be observed by cameras, video cameras, imagers, or other elements capable of generating video or images from which position or orientation may be computed. Other embodiments employ positioning interfaces as signal transmission or reception functions from which propagation delay computations may be used to determine position or orientation. Yet other embodiments employ a combination.

In FIG. 7E, bearing 721 and handle 717 are also shown. Bearing 721 may be a simple bearing consisting of an axle and cylindrical sleeve, a roller bearing, a ball bearing or other types of bearing. Certain embodiments couple ear support 714 to main tube 704, end housing 718, and other elements of a positioning device through a bearing 721 to allow the positioning device to pivot at the bearing 721. Consequently, ballast or weight from batteries, electronics, and other elements within end housing 718 act as a lever force over bearing 721 to keep head band 708 against the forehead of user 702, improving the stability of head band 708 on the forehead of user 702. Rotary springs, springs, elastic, rubber bands, or other elements could further be used to pull ear supports 714 against the back of the ears of user 702 by pulling against ear support 714 relative (in a forward direction so as to create pressure on the back of the ears of user 702) to other portions of a positioning device. Handle 717 is shown attached to ear support 714 and configured to allow user 702 or another person to rotate ear support 714 in bearing 721. Handle 717 or other embodiments of handles, tabs, knobs, levers, extensions, or other features allowing a person to easily rotate ear support 714 may benefit some embodiments as they may allow user 702 or another person to more easily put on and position positioning device with easily visible features 701 or other possible positioning devices more easily.

In FIG. 7F, an embodiment of a positioning device with easily visible features 703 is shown in which like numbered elements perform substantially identical functions to those of positioning device with easily visible features 701, shown in FIG. 7E. Positioning device with easily visible features 703 as shown in FIG. 7E does not include bearing 721 or handle 717 (although some embodiments of it do), but employs ear support 714 as was shown for positioning device with tubular construction 700. Additionally, positioning device with easily visible features 703 includes dots 730, stripes 732, and stripes 734. Dots 730, stripes 732, and stripes 734 are the result of illumination with structured light from a light source such as illumination device 218 on hair cutting device 200 as shown in FIG. 2. Visible features from structured light such as dots 730, stripes 732, and stripes 734 offer additional information as the application of structured light may allow distance and orientation to be determined from analysis of the dots 730, stripes 732, stripes 734, or other features resulting from structured light. For example, the center-to-center distance between dots 730 may provide an indication of how far they are away from the structured light illumination source (and, hence, how far away they are from hair cutting device 200 if the illumination source is mounted on hair cutting device 200).

A positioning interface may be a visible or invisible feature, specifically, the positioning interface may be any possible feature or element that could be observed or interacted with to generate position information. The positioning interface may be a physical marking, a decal, an image, a paint mark, an indentation, a recognizable physical feature, a recognizable physical structure, an electronic transmitter, an electronic receiver, an antenna, a speaker, a microphone, a transducer, a sensor, a sensing point, or any other possible feature or structure or combination of features or structures that may be detected in some fashion, whether visible or not, so that position information may be determined.

FIG. 7F also includes auxiliary positioning device 740 around the neck of user 702. Auxiliary positioning device 740 includes positioning interfaces 742 and may include all types of positioning interfaces that have been described. Auxiliary positioning device 740 provides an example and shows that positioning devices may be broken into multiple parts that interact with each other, with hair cutting devices and other possible elements of an automated hair cutting system 100 through wired or wireless interfaces. It is noted that auxiliary positioning device 740 is around the neck of user 702, so it would not normally move with the movement of the head and face of user 702. However, through interaction with positioning device with easily visible features 703, the position and orientation of auxiliary positioning device 740 may be computed allowing positioning interfaces 742 to provide beneficial information to automated hair cutting system 100. Many different types of auxiliary positioning devices are possible that may be affixed to a user 702 in a wide variety of positions and orientations so that a wide range of benefits may be delivered.

Figure 8A:
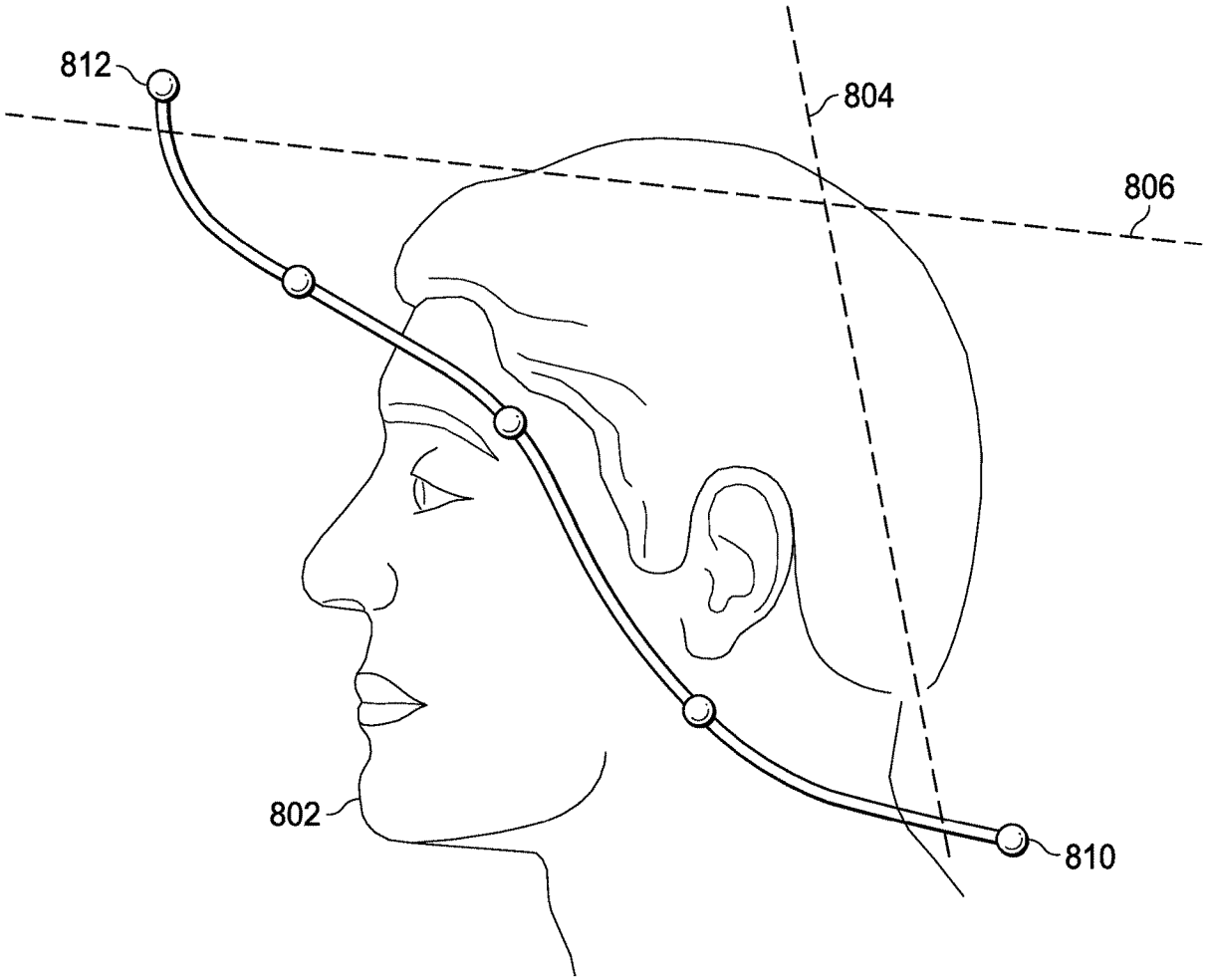
FIG. 8A is an illustration of an embodiment of a positioning device having tubular construction and positioning interfaces extending above a user's head and behind the head.

FIG. 8A shows an embodiment of a positioning device with tubular construction in which some positioning interfaces extend above a user's head 802 or extend behind. In FIG. 8A, upper positioning interface 812 is shown above top reference line 806 that extends over the top of user's head 802 so that substantially all regions of the top user's head 802 have a line of sight connection possible to upper positioning interface 812. Lower positioning interface 810 is shown behind back reference line 804 that extends behind user's head 802 so that substantially all regions of the back of user's head 802 have a line of sight connection possible to lower positioning interface 810. Embodiments such as the one of FIG. 8A in which some regions of user's head 802 have line of sight connections possible to some positioning interfaces may offer benefit of additional accuracy. This may be especially true if light, optical, infrared or other signals that propagate in straight lines are used as positioning signals in an automated hair cutting system 100.

Figure 8B:
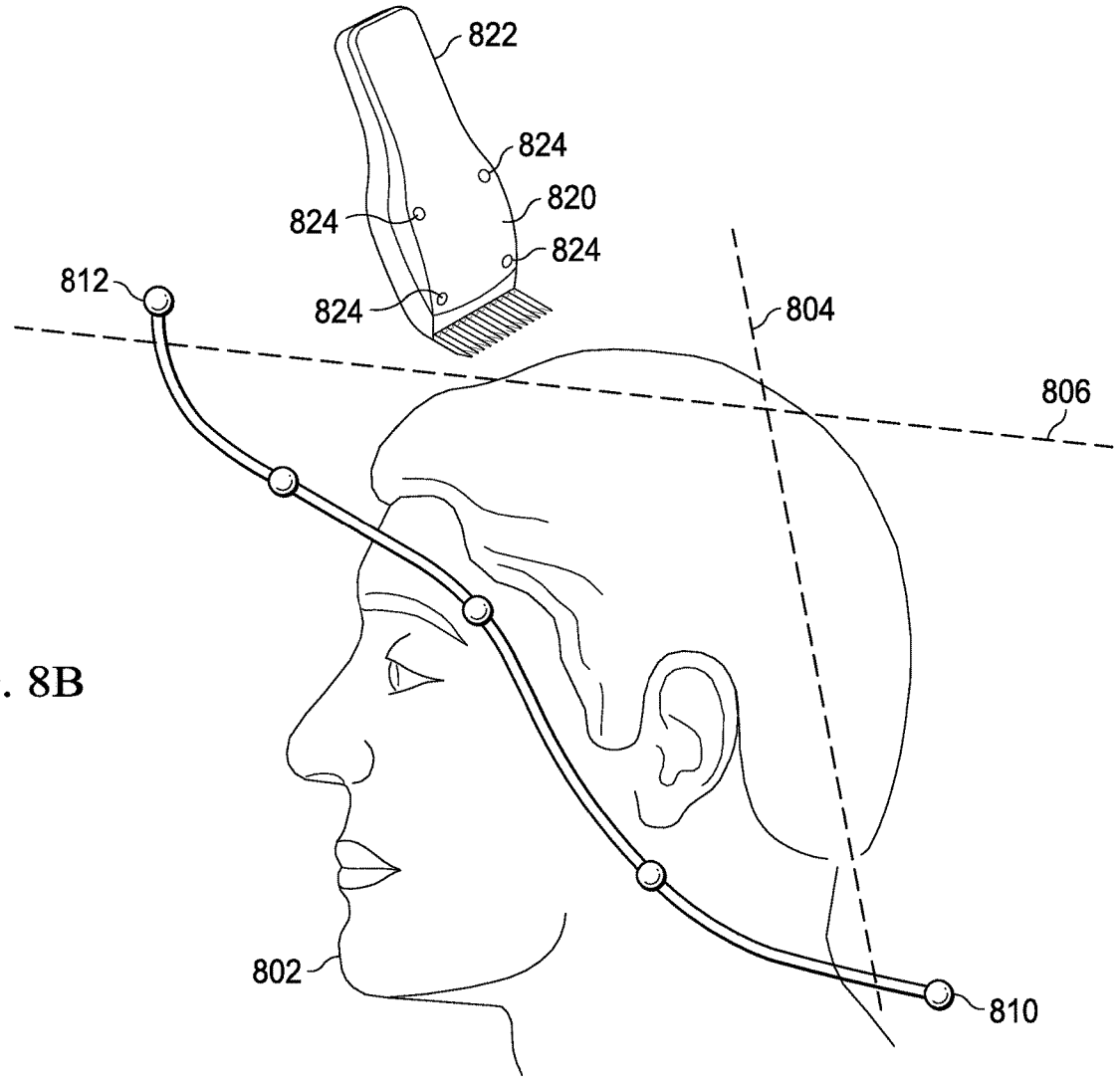
FIG. 8B is an alternate illustration of the embodiment of FIG. 8A having a hair cutting device.

FIG. 8B shows the embodiment of FIG. 8A of a positioning device with tubular construction in which some positioning interfaces either extend above user's head 802 or extend behind; and further illustrates how sensors 824 may be placed on a hair cutting device 820 so that obstruction from the hands and arms of a person operating the hair cutting device 820 may be minimized. In FIG. 8B, sensors 824 are placed substantially near the cutter head of hair cutting device 820 and an extended handle 822 is provided so that hands and arms may be kept substantially away from the path between sensors 824 and at least some of the positioning interfaces shown in the embodiment. As is visible in FIG. 8B, the hand or arm of a person on handle 822 of hair cutting device 820 may be easily kept away from a line of sight from the sensors 824 shown on hair cutting device 820 to upper positioning interface 812. Similarly, sensors 824 may benefit from reduced obstruction due to hands and arms of a person on the handle 822 of hair cutting device 820 to lower positioning interface 810 when hair cutting device 820 is positioned behind user's head 802. While the embodiment of a hair cutting device 200 shown in FIG. 2 included a sensor 208 on handle 206 for the benefit of maximum spacing of the sensors 208, FIG. 8B illustrates that certain embodiments minimize obstruction from the hands and arms of people operating automated hair cutting system 100 if sensors 824 are kept substantially away from handle 822 of hair cutting device 820 as shown.

Figure 9:
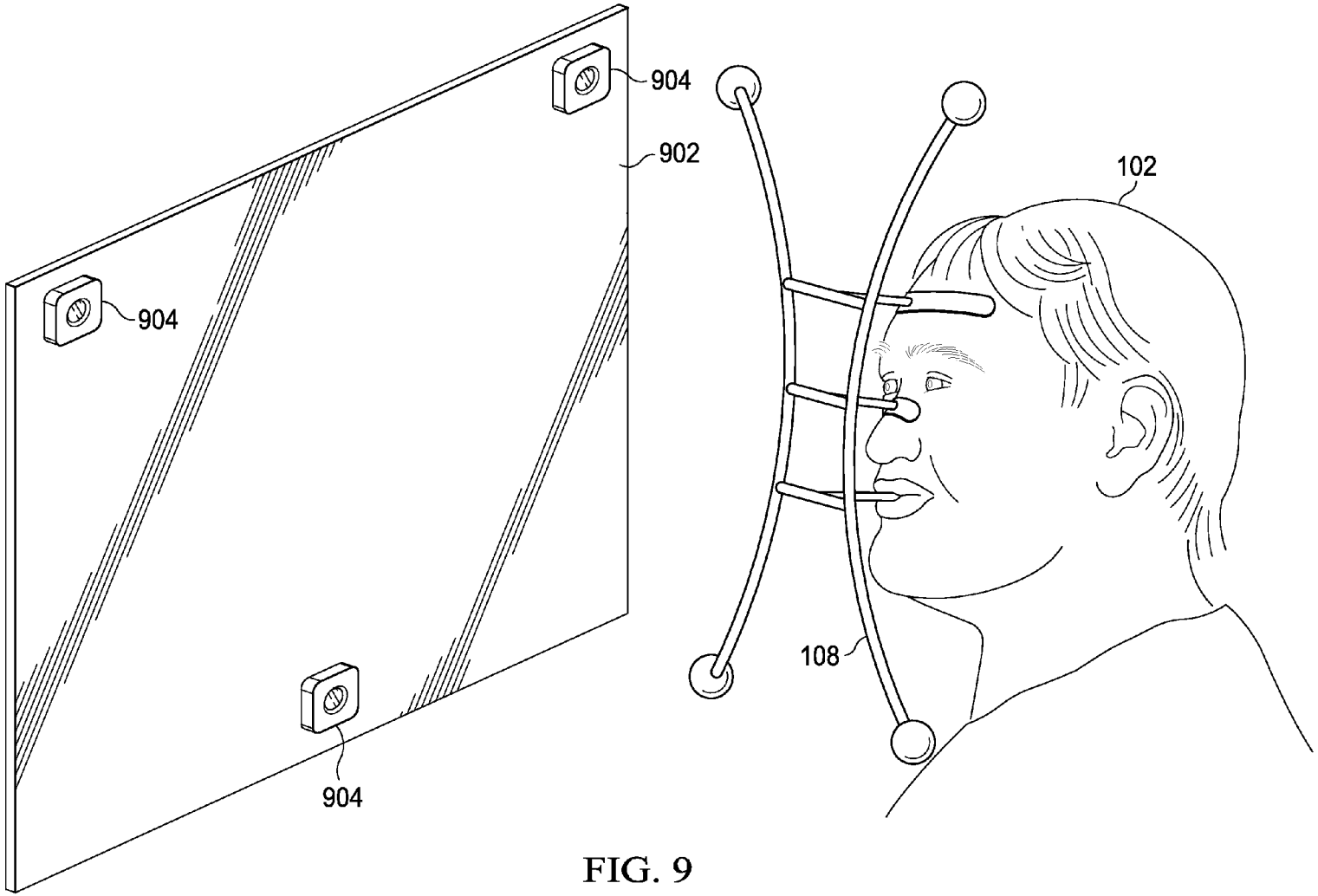
FIG. 9 is an illustration of another embodiment of an automated hair cutting systems having sensor hubs coupled to a wall or mirror.

FIG. 9 shows an embodiment of an automated hair cutting system in which sensor hubs 904 contribute to operation of the automated hair cutting system and in which sensor hubs 904 are affixed to a wall, mirror 902, or are otherwise mounted near a user 102. Certain embodiments employing sensor hubs 904 offer improved accuracy of automated hair cutting system 100, or may reduce size, weight, or complexity of a positioning device 108. Positioning device 108 may communicate with sensor hubs 904 through wired or wireless interfaces. Sensor hubs 904 may be battery operated or receive power through wires. Sensor hubs 904 may be affixed to mirror 902 or other surfaces with adhesive, tape, suction cups, or other techniques. Sensor hubs 904 may contain positioning interfaces 712 (as previously described), cameras, imagers, radar, sonar, lidar, structured light illumination sources, scanning lasers, or other electronic elements that allow sensor hubs 904 to monitor the position, orientation, hand position, arm position, head position, hair position, hair style, and/or other aspects of user 102. Sensor hubs 904 may also contain indicator lights, buzzers, chimes, speakers, microphones, gesture recognition devices, time-of-flight monitors, or other elements that allow sensor hubs 904 to communicate with user 102. Information may be exchanged between multiple sensor hubs 904, user 102, positioning device 108, electronic computing device 106 (not shown in FIG. 9), hair cutting device 200 (not shown in FIG. 9), and other possible elements of automated hair cutting system 100 to provide guidance, control and other information that may be beneficial in the operation of automated hair cutting system 100. The embodiment of FIG. 9 shows three sensor hubs 904, but embodiments with other numbers of sensor hubs 904 are also possible.

Figure 10A:
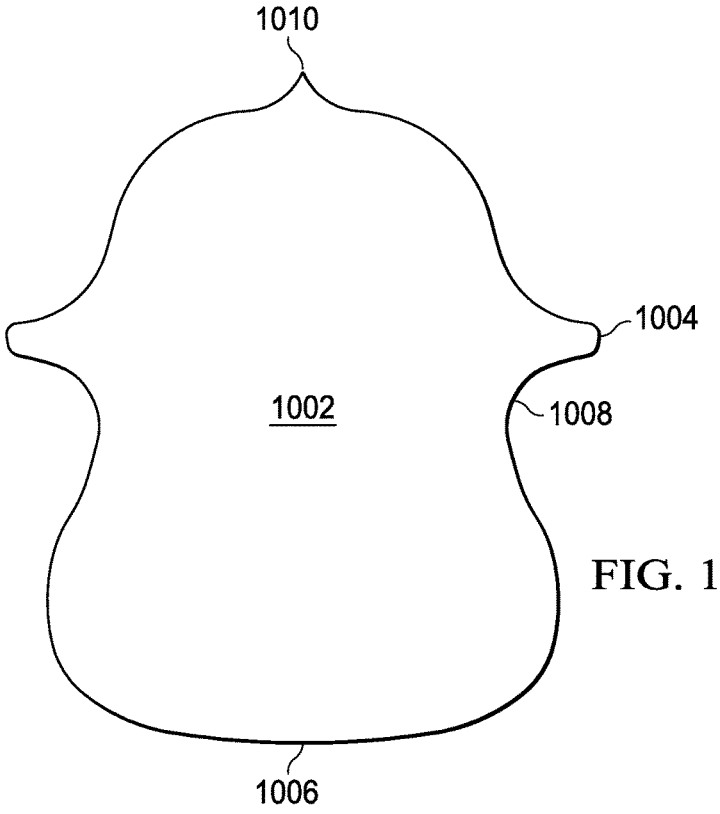
FIG. 10A is an illustration of one embodiment of an outline of a human scalp.

FIG. 10A is an illustration of one embodiment of an outline 1002 of a first type of human scalp. Human scalp outline 1002 may be formed by flattening a three-dimensional model of a human scalp to form a two-dimensional outline as shown in FIG. 10A. Flattening a three-dimensional model of a human scalp to form a two-dimensional human scalp outline may involve some stretching and/or compression of some parts of the model and such an operation may mean that the distances between points on outline 1002 may not correspond precisely with distances between the same represented points on a corresponding three-dimensional model (much as two dimensional maps of the earth include some stretching or expansion versus distances on an earth globe). For many hair styles a substantially smooth translation of hair length from one region of a person's scalp to another is employed and so, such distortions in the modeling process may not cause problems in achieving an acceptable haircut. Different human beings have different scalps. Certain aspects of outline 1002 shown in FIG. 10A include a front peak 1010, a side burn 1004, an ear opening 1008, and a flat back 1006. Outlines such as outline 1002 in FIG. 10A may be employed in some embodiments of automated hair cutting systems 100 as a user 102 of such a system may provide information about the type of scalp they have or through use of automated hair cutting system 100, information about the type of scalp user 102 has may be determined directly by measurements, camera images, and other techniques. The information may be employed to determine possible hair styles, modifying or adjusting styles for beneficial results, fitting particular hair styles to a specific user 102, or for other purposes.

Figure 10B:
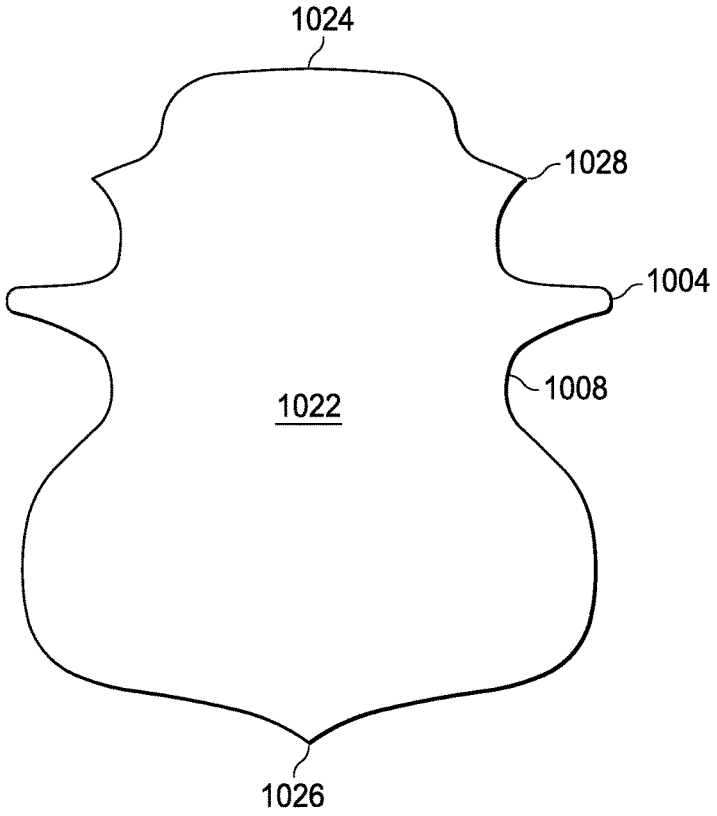
FIG. 10B is an illustration of another embodiment of an outline of a human scalp.

FIG. 10B is an illustration of another embodiment of a human scalp outline 1022. Outline 1022 is an example of a human scalp having a flat front 1024, a side peak 1028, a side burn 1004, an ear opening 1008, and a back peak 1026. Various embodiments of an automated hair cutting system 100 provide many different human scalp outlines that may be associated to specific users. Some of these human scalp outlines may be specific to males and females, while others may be applicable to people of either sex.

Figure 10C:
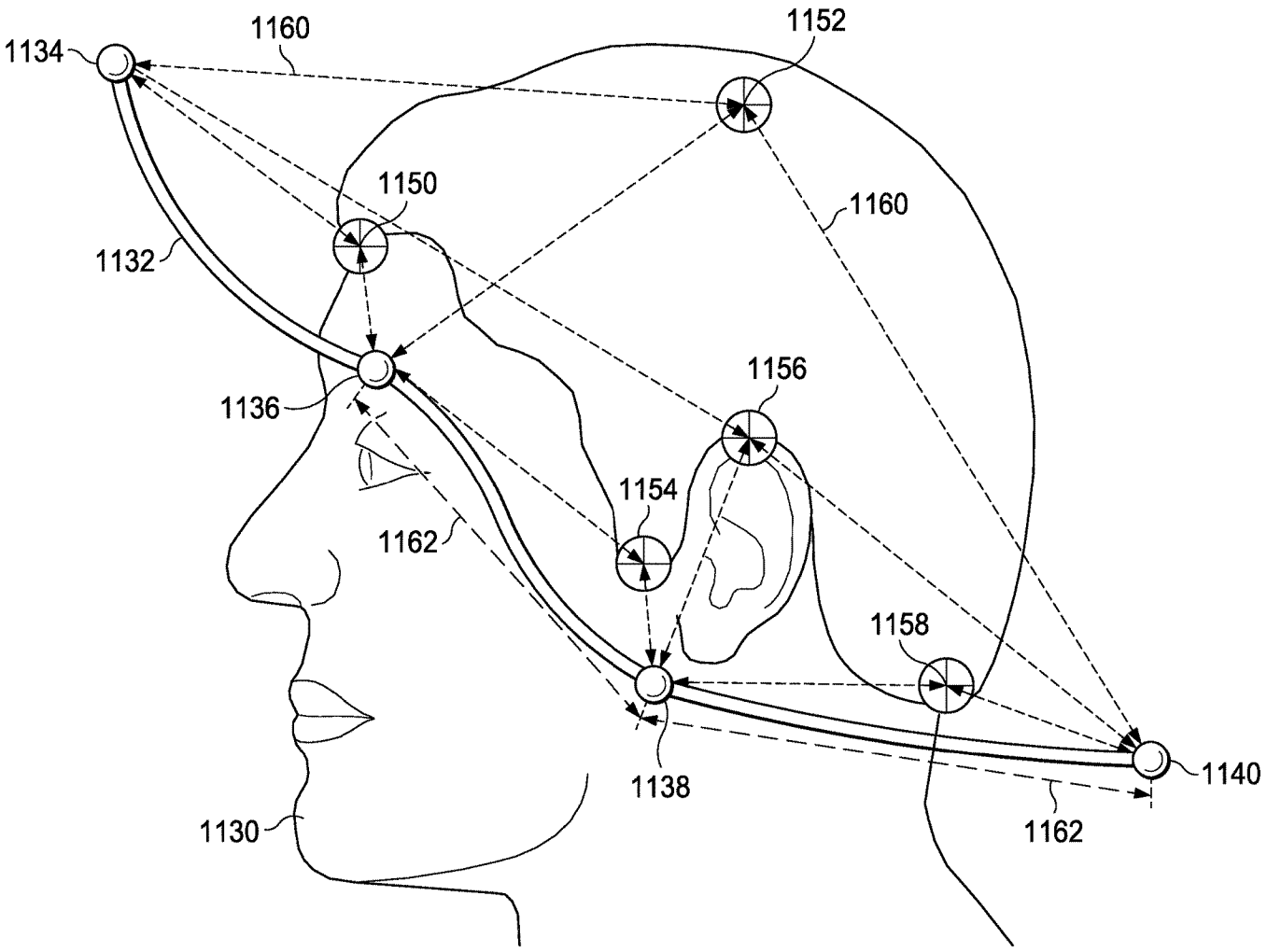
FIG. 10C is an illustration of how, in one embodiment, locations of positioning interfaces on a positioning device may be determined relative to reference points on a user's head.

FIG. 10C is an illustration of how the location of positioning interfaces on a positioning device may be determined relative to reference points on the head of a user 1130. The embodiment of FIG. 10C is based on signal propagation times from positioning interfaces to sensors on a hair cutting device or stylus. Additional embodiments are possible that include position or orientation measurements based on camera images, radar, sonar, lidar, images taken under illumination by structured light, and by other techniques. First positioning interface 1134, second positioning interface 1136, third positioning interface 1138, and fourth positioning interface 1140 are mounted on main tube 1132. Additional positioning interfaces, head bands, ear supports, hinges, other supports and other possible features of some embodiments of a positioning device are not shown in FIG. 10C to avoid cluttering the figure. In FIG. 10C, main tube 1132 and the positioning interfaces as shown are part of an embodiment of a positioning device. First reference point 1150 at front center of user's 1130 scalp, second reference point 1152 at top center of user's 1130 scalp, third reference point 1154 at lower end of side burn of user's 1130 scalp, fourth reference point 1156 at top of user's 1130 ear, and fifth reference point 1158 at back center of user's 1130 scalp are shown in FIG. 10C as circles with cross hairs inscribed. Positioning interface locations may be established relative to reference points by prompting a user 1130 or other person operating automated hair cutting system 100 to position hair cutting device 200, stylus 1302, or other suitable device to a desired reference point and provide an acknowledgement to automated hair cutting system 100 that the hair cutting device 200, stylus 1302, or other suitable device is properly positioned at the reference point, so that the distances from each sensor 208, located on such a stylus 1302, hair cutting device 200, or other suitable device to each positioning interface, may be determined. Distance ranges 1160 from the positioning interfaces to the reference points in FIG. 10C may be substantially precisely measured as explained previously from signal propagation measurements or other described techniques. As shown in FIG. 10C, multiple distance ranges 1160 are shown from each reference point to each positioning interface. In certain embodiments it is not possible to measure the distance range 1160 from every reference point to every positioning interface as the head of user 1130, or other obstructions may block some signal paths. However, certain embodiments will allow a sufficiently large number of distance ranges 1160 to be measured so that automated hair cutting system 100 may operate. FIG. 10C also shows positioning interface distance ranges 1162 that represent the distance from one positioning interface to another. Depending on the design of a specific positioning device, the distance from various positioning interfaces to other positioning interfaces may or may not be precisely known. A specific embodiment of a positioning device may contain hinges, flexible members, telescoping members, or other features that allow the dimensions between various positioning interfaces to vary from one use to a next. Some embodiments of positioning devices may allow the distance between various positioning interfaces to be determined electronically. As shown in FIG. 10C, the distance between some of the positioning interfaces may be known and those known positioning interface distance ranges 1162 may also be used in computations to determine positioning device locations based on reference points. Multiple distance ranges 1160 or positioning interface distance ranges 1162 from each reference point to each positioning interface, or between positioning interfaces, allow substantially precise locations of positioning interfaces to be computed relative to the reference points as shown in FIG. 10C. If reference point locations are known, then the locations of positioning interfaces may be determined from them as described. If the reference points of the embodiment of FIG. 10C are established on a scalp outline such as human scalp outline 1002, human scalp outline 1022, or other possible human scalp outlines, then the location of first positioning interface 1134, second positioning interface 1136, third positioning interface 1138, and fourth positioning interface 1140 may also be substantially projected on the scalp outline. Reference point locations may also be determined with reference to solid models such as three-dimensional model 1102 shown in FIG. 11. In certain embodiments three or more distance ranges 1160 or positioning interface distance ranges 1162 are needed to determine the location in three dimensional space of a positioning interface relative to the locations of the reference points from which those distance ranges 1160 were determined. Embodiments of automated hair cutting systems 100 may employ multiple sensors 208 on hair cutting devices 200 or on stylus 1302, so several distance ranges 1160 between the various sensors and positioning interfaces may be measured. Embodiments employing such an over-determined system may mitigate sensors or positioning interfaces being blocked at various times by the hands or arms of user 1130, other people or covered with hair or other items (such as combs, brushes, etc.). Such an over-determined system may also allow embodiments of the system and method to accommodate a range of users with various sized and shaped heads. In embodiments employing three-dimensional models, three-dimensional mathematics may be applied and substantially precise locations of the various sensor interfaces relative to the reference points of the scalp of a user 1130 may be determined. In embodiments employing two-dimensional scalp outlines, various distortions and approximations are involved to transform a three-dimensional human scalp to a flat plane human scalp outline. With regard to the positioning interfaces shown in FIG. 10C, for example, their positions may be projected to a human scalp outline by determining their perpendicular projection to a plane tangential to the scalp or head of user 1130.

If all users 1130 of an automated hair cutting system 100 had the same size and shape of head then reference point locations could be measured and used for all possible users of automated hair cutting system 100, and the embodiment of FIG. 10C would then be closely analogous to GPS (Global Positioning System) (since there is only one Earth inside the GPS satellite constellation). Certain embodiments accommodate many different users 1130 with a large range of head sizes and shapes, ear locations, and scalp sizes. Certain embodiments assume a standard head model, such as three-dimensional model 1102 with reference point locations that are substantially precisely known in three-dimensional space. It is then possible to vary the assumptions of the size, shape, and other features of the standard head model so that the distance ranges 1160 measured result in self-consistent computations for the locations of the positioning interfaces, regardless of which distance ranges are used to compute the location of a specific positioning interface. For example, if a specific user 1130 has a smaller head than an assumed standard head model, then the distance range 1160 measured from first reference point 1150 to first positioning interface 1134 may be inconsistently long relative to the measured distance range 1160 from fourth reference point 1156 to first positioning interface 1134. This concept applies to many distance ranges 1160 that may be inconsistent if an assumed standard head model does not sufficiently match the shape and size of the head of the specific user 1130 using the automated hair cutting system 100. Alternate embodiments are possible where adjustment of the size assumptions of the standard head model will allow the many distance ranges 1160 measured to become sufficiently self-consistent; and once this is accomplished, the locations of each positioning interface may be sufficiently computed. Recursive algorithms, analytic algorithms, search algorithms, and other types of algorithms may be employed to determine a correct head model with reference point locations that match those of the specific user 1130 to acceptable tolerances.

Other embodiments employ alternate approaches to determine and fit reference points of a specific user to a model so that consistent positioning interface locations may be computed and hair styles may be fitted to those models. These approaches include direct measurement to determine the size and shape of the head of a specific user 1130, analysis of camera images of a specific user 1130, analysis of camera images of a specific user 1130 taken under illumination with structured light, precision measurement of the locations of reference points of a specific user 1130 using a substantially precise three-dimensional measurement system, solid modeling techniques, or Lidar scanning.

Since embodiments may exist in which positioning interface locations are substantially over-determined by reference point locations and measured distance ranges 1160, as previously explained, it is also possible to favor certain reference point locations and measured distance ranges 1160 for the determination of a specific positioning interface location. For example, third positioning interface 1138 is near the ear of user 1130 in FIG. 10C, so some embodiments may favor signals from third positioning interface 1138 in determining the position and orientation of hair cutting device 200 for hair cutting operations near the ear of user 1130. Certain embodiments may favor reference points near the ear of user 1130 in determining the location of third positioning interface 1138, so that more precise hair cutting may be substantially achieved. In other words, use of third reference point 1154, fourth reference point 1156 and fifth reference point 1158 may be favored for the determination of the location of third positioning interface 1138, as shown in FIG. 10C, versus other possible reference points.

Some hair cutting operations may benefit if certain positioning interface locations are substantially more precise relative to certain reference points, and that other hair cutting operations may benefit if those same positioning interface locations are substantially more precise relative to other reference points. Consequently, certain embodiments are possible in which positioning interface locations are recomputed from more favorable reference points specific to hair cutting operations about to be undertaken. In this fashion, positioning interface locations may be recomputed multiple times during a haircut to improve precision.

In certain embodiments, a mathematical correction may be employed in orientation measurements using the stylus 1302, hair cutting device 200 or other device. Such corrections may include use of accelerometers or other orientation, tilt, or gravity sensing devices.

Signal propagation times from a positioning device to multiple sensors on a stylus 1302, hair cutting device 200, or other device may be used to measure reference points in some embodiments. Errors in orientation using signal propagation measurements, arising before reference points and positioning interfaces have been substantially determined, may be managed by using sensors and positioning interfaces for orientation measurement that are normally positioned to be insensitive to precise sensor or positioning interface location. Alternatively, relatively minor errors may be accommodated without compensation.

Figure 10D:
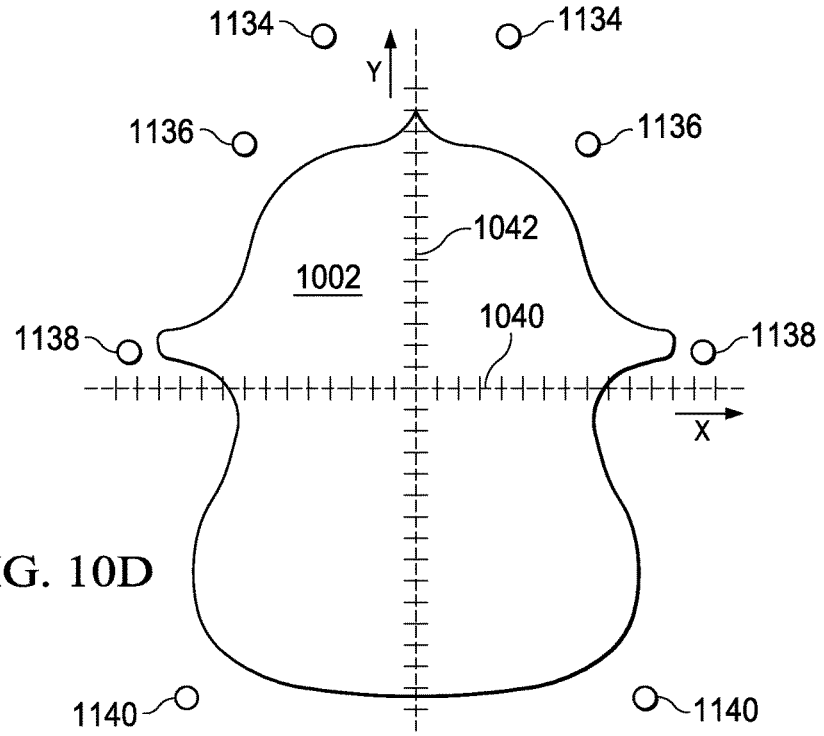
FIG. 10D is an illustration of an X- and Y-axis and positioning interfaces on the embodiment of FIG. 10A.

FIG. 10D shows the outline of a first type of human scalp from FIG. 10A where positions on the human scalp outline 1002 may be designated by coordinates relative to an embodiment of an x-axis 1040 and a y-axis 1042. Incorporation of an x-axis 1040 and a y-axis 1042 may allow any point on the scalp of a user of an automated hair cutting system 100 to be referenced relative to the x-axis 1040 and/or the y-axis 1042 with numerical coordinates. These numerical coordinates may provide distances in quantified measures such as millimeters, centimeters, inches, etc., or in relative distance as a percentage of the size of human scalp outline (for example, as a percentage of the total dimension of human scalp outline 1002 along the y-axis 1042). The location of the positioning interfaces shown in FIG. 10C are shown projected onto the coordinate system shown in FIG. 10D. As noted in the description of FIG. 10C, such a projection may be computed as a perpendicular projection from a positioning interface to the surface of the scalp or head of a user, but other projections are also possible. As FIG. 10C was a side view of the head of user 1130, only four positioning interfaces were visible; whereas the scalp outline of FIG. 10D includes the additional four positioning interfaces around the head of user 1130 that were not visible in FIG. 10C. The positioning interfaces of FIG. 10C are shown like numbered for the left and right sides of FIG. 10D (that is, left and right of the y-axis 1042) and first positioning interface 1134, second positioning interface 1136, third positioning interface 1138, and fourth positioning interface 1140 are shown. Many alternate systems of coordinates and axes are possible in addition to the rectangular coordinates shown in FIG. 10D. For example, a polar coordinate system based on angles from a reference vector and distance from a center point may also be used. A very wide range of coordinate systems are possible and may be applied.

Figure 10E:
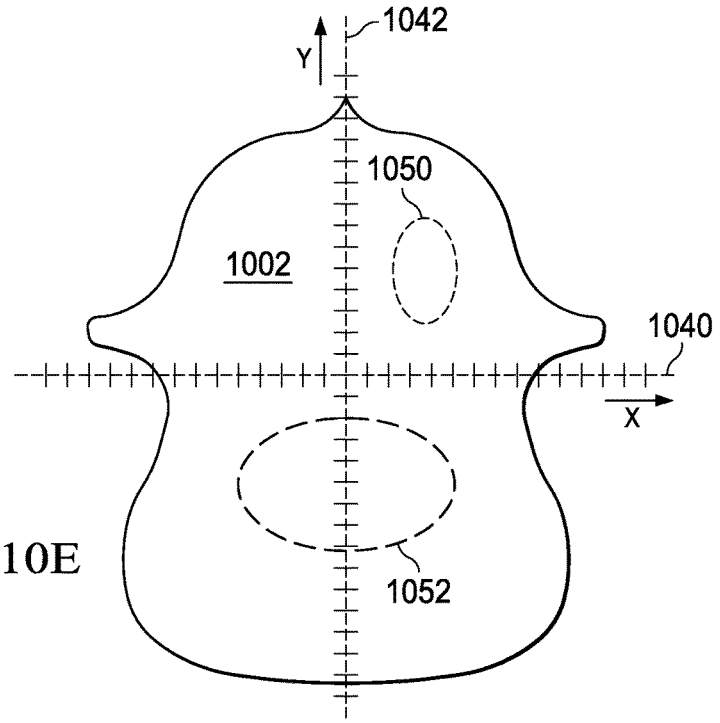
FIG. 10E is an alternate illustration of the embodiment of FIG. 10A having a region of thinned hair and a region of a skull irregularity.

FIG. 10E shows the outline of a first type of human scalp from FIG. 10A in which a region of thinned hair 1052 and a region of a skull irregularity 1050 are designated relative to an embodiment of an x-axis 1040 and a y-axis 1042. Human's may have regions of their scalp with especially thick or thin hair, regions of coarse hair, bald spots, regions with gray or graying hair, or other irregularities in their hair. Humans may have regions of their skull that are normally shaped, but have depressions, ridges, or other irregularities. By noting these regions as shown by example in FIG. 10E, certain embodiments of automated hair cutting system 100 may account for them and make adjustments to hair styles and recommendations to users of the system so that they achieve potentially beneficial results. The region of thinned hair 1052 and the region of a skull irregularity 1050 in FIG. 10E may be encoded with coordinates relative to the x-axis 1040 and the y-axis 1042.

Figure 10F:
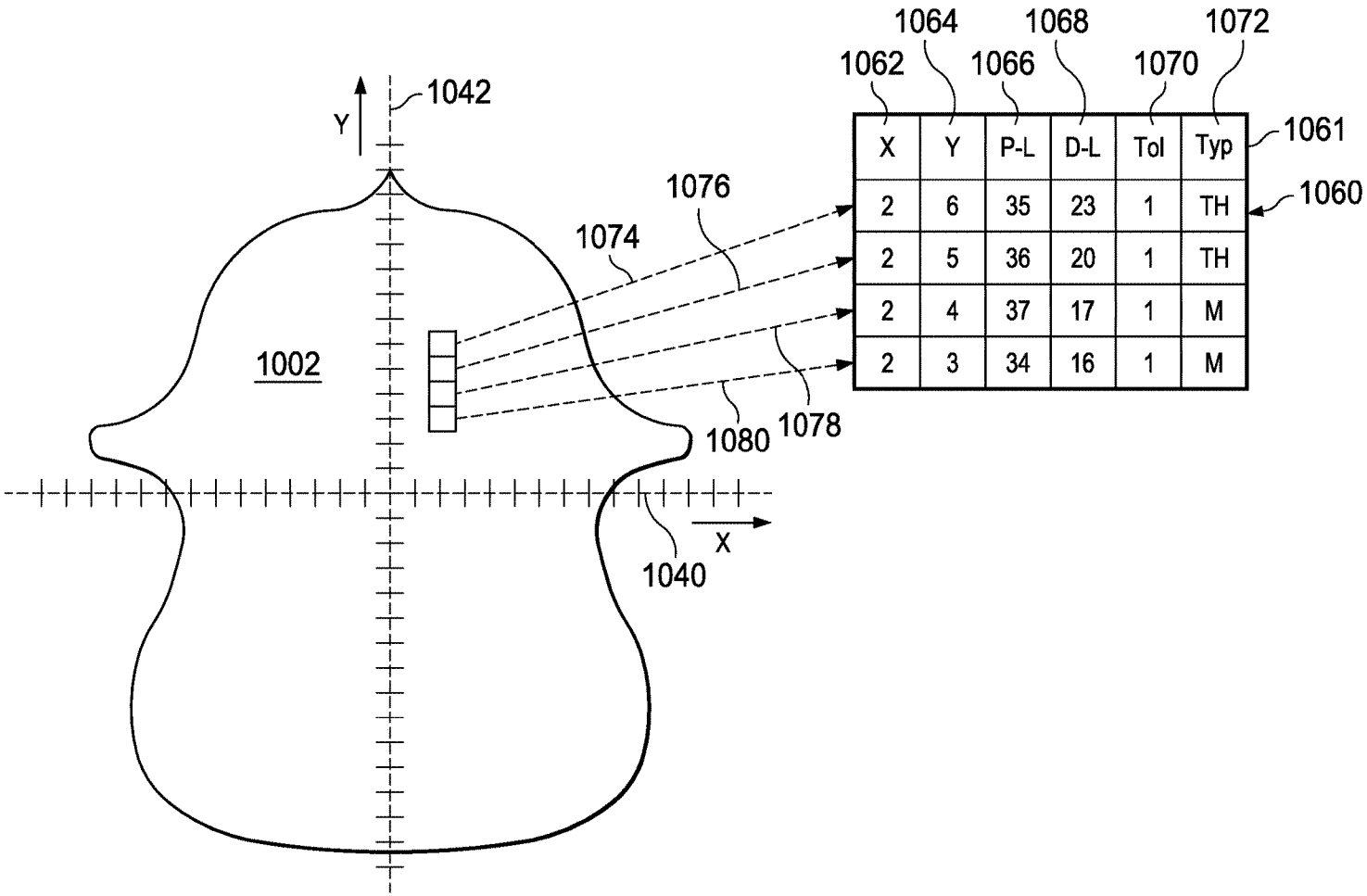
FIG. 10F is yet another alternate illustration of the embodiment of FIG. 10A having a table providing information specific to hair in specific regions of the scalp.

FIG. 10F shows an embodiment of a table 1060 that provides information specific to hair in specific regions of a first type of human scalp outline 1002 where the specific regions are designated by coordinates relative to an embodiment of an x-axis 1040 and a y-axis 1042. Title row 1061 of table 1060 provides representative column headings that are optional and may not be present in all embodiments. Each row of table 1060 below the title row 1061 includes a coordinate in a first column 1062 that references x-axis 1040, and a coordinate in a second column 1064 that references y-axis 1042. For each row in table 1060, the remaining columns provide information about the hair in the region referenced by the coordinates in the first column 1062 and second column 1064 as follows: a third column 1066 provides a present length (designated P-L in table 1060), a fourth column 1068 provides a desired length (designated D-L in table 1060), a fifth column 1070 specifies an accuracy tolerance to which hair should be cut (designated Tol in table 1060), and a sixth column 1072 provides an indicator of the thickness of hair (designated Typ and denoted: TH for thin, M for medium in table 1060). First reference line 1074 shows how a specific region on human scalp outline 1002 is mapped to the first row of table 1060. Second reference line 1076 shows how a specific region on human scalp outline 1002 is mapped to the second row of table 1060. Third reference line 1078 shows how a specific region on human scalp outline 1002 is mapped to the third row of table 1060. Fourth reference line 1080 shows how a specific region on human scalp outline 1002 is mapped to the fourth row of table 1060.

Mapping from human scalp outline 1002 to table 1060 as shown in FIG. 10F allows all regions of human scalp outline 1002 to be mapped such that a substantially complete tabular record of human scalp outline 1002 may be created in table 1060 through the addition of rows to table 1060. It is clear that each row of table 1060 contains specific information regarding how hair is to be cut in that specific region and that with other aspects of the system and method, specific hair styles may be represented for specific people so that acceptable results may be achieved. Table 1060 may also include other or additional columns to provide information regarding hair types (bristly, curly, straight, etc.), hair color (gray, white, blond, brown, etc.), skull irregularities (may be noted as higher or lower regions with deviations from nominal provided as quantified measurements), or any other features of hair relative to specific regions of human scalp outline 1002. In certain embodiments, table 1060 may be represented in a computer as an array of numbers, as a spreadsheet, or through other electronic computing techniques. It is noted that the numerical values presented in table 1060 are for example purposes only and, apart from the first column 1062 and second column 1064 that correspond to locations of human scalp outline 1002 as already shown and explained, the numerical values in table 1060 do not convey numerical information of specific interest.

Human scalp outline 1002 and table 1060 as presented in FIG. 10F, may substantially contain the information needed by automated hair cutting system 100 to determine the length hair should be cut to for a user 102. It was explained in the description of FIG. 1 that user 102 may be asked to place hair cutting device 200 or a stylus 1302 on reference points so that positions on the head and scalp of user 102 may be accurately referenced by positioning device 108. Referring again to FIG. 1, these reference points may include the tops of user's ears 152, the back of user's neck at a collar line 154, the tops of user's eyebrows 150, and other reference points that are of specific interest in properly fitting a given hairstyle to a user's 102 head and facial features. Other reference points might include the front and back of a user's ears, the sides of a user's 102 eye sockets, the user's 102 hair line (the point at which the user's 102 hair scalp ends and skin without thick hair begins) at various points around the user's 102 scalp, and other reference points. Those skilled in the art will recognize that by determining reference points as described, the human scalp outline 1002 and table 1060 of FIG. 10F may be referenced to specific locations on the head of a user 102 for a specific placement of positioning device 108 on the head of user 102. And in this way, table 1060 may be used to provide substantially precise information for how long to cut the hair at each region of a user's 102 scalp so that automated hair cutting system 100 may achieve acceptable results.

Figure 11:
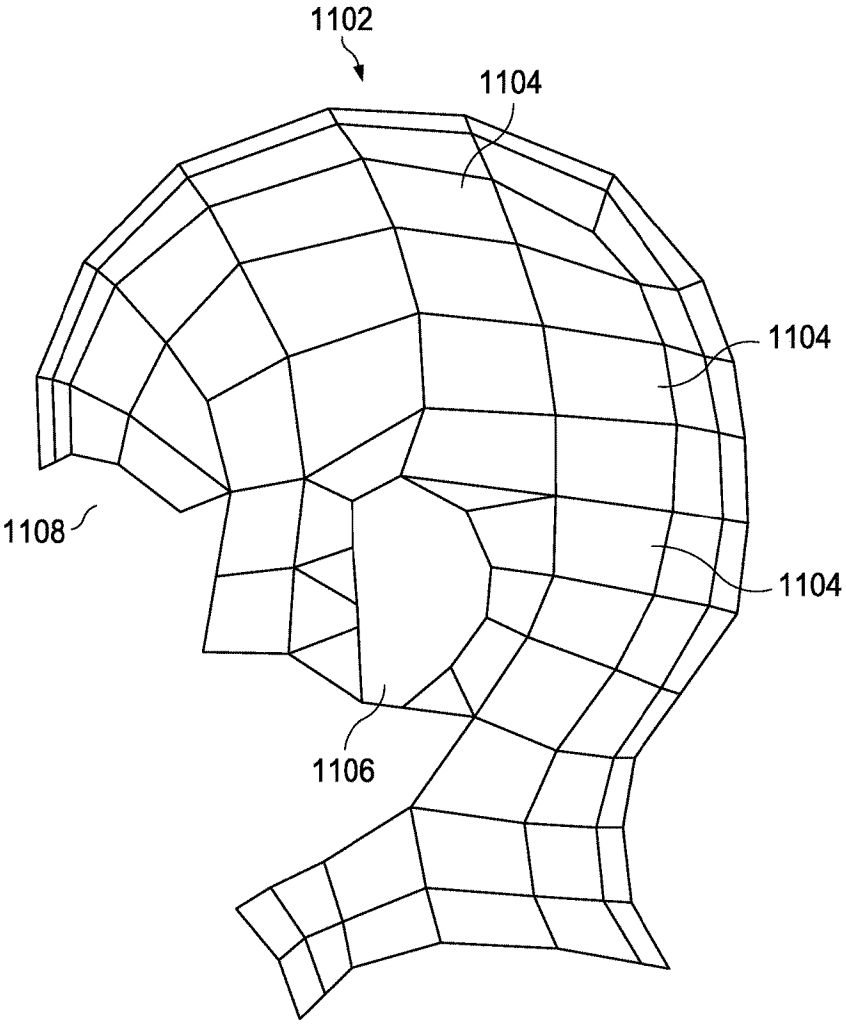
FIG. 11 is an illustration of one embodiment of a three dimensional model of a human head.

FIG. 11 is an illustration of an embodiment of a three-dimensional model 1102 of a human head. Three-dimensional model 1102 partitions the surface of a human head into specific regions 1104. Three such specific regions 1104 are numbered for reference in FIG. 11, but all the rectilinearly defined regions may be specifically referenced. Since certain regions of the human head may not be of interest in the operation of an automated hair cutting system 100, no rectilinearly defined regions are defined for the eye socket area 1108 and the ear area 1106. Certain embodiments of automated hair cutting system 100 may employ a three-dimensional model 1102 of a human head instead of the two-dimensional scalp outlines that were explained in FIGS. 10A-10F. Other embodiments employ coordinate axes and tabular information as was explained in FIGS. 10A-10F extended to a three-dimensional model 1102 such as the one shown in FIG. 11 and may be used in a similar fashion in support of operation of automated hair cutting system 100.

Figure 12:
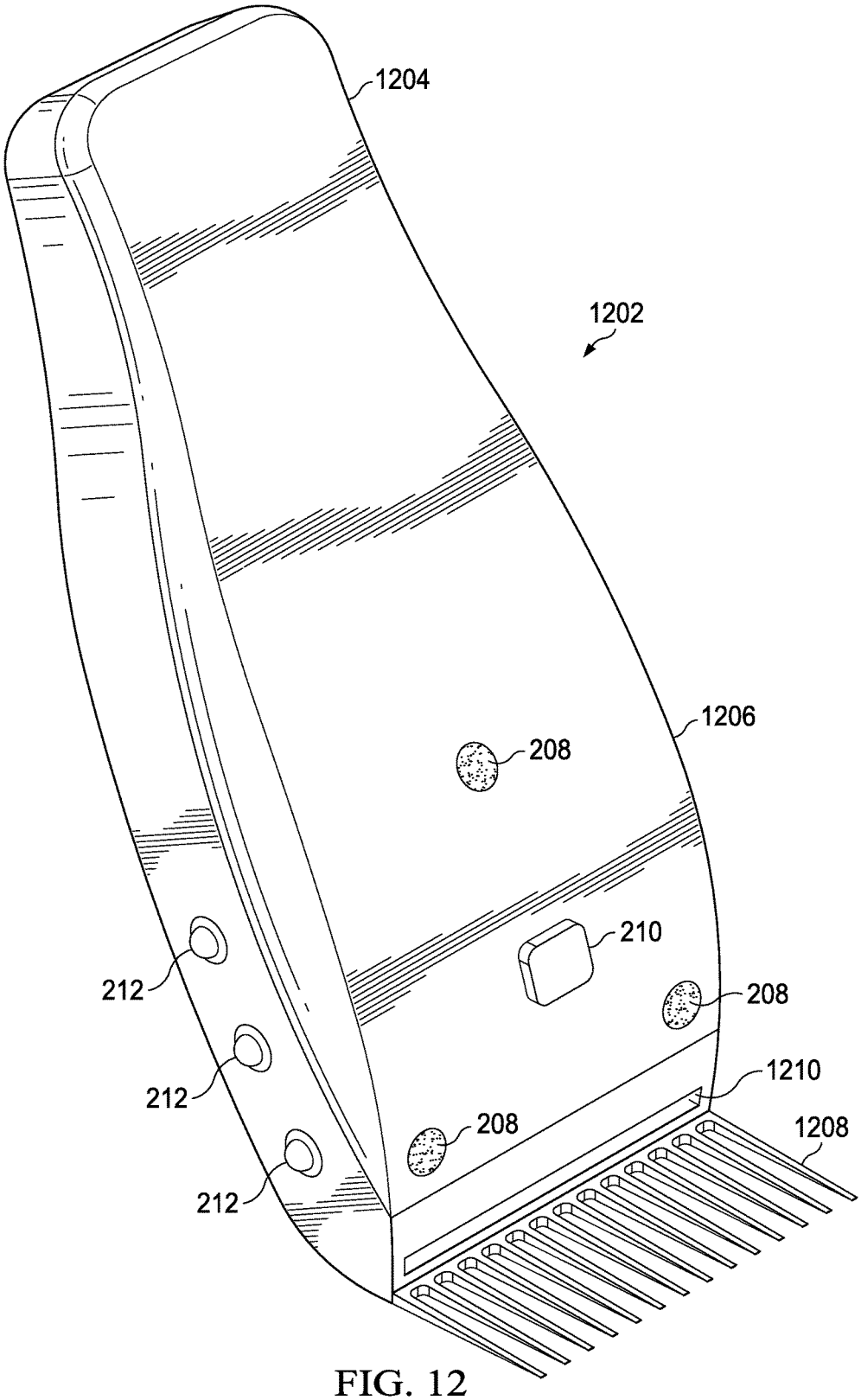
FIG. 12 is an illustration of one embodiment of a hair dye dispensing device.

FIG. 12 is an illustration of one embodiment of a hair dye dispensing device 1202 including sensors 208, indicator lights 212, accelerometer 210, body 1206, handle 1204, comb 1208, and dispensing slot 1210. Hair dye dispensing device 1202 provides an example of an alternative device to a hair cutting device 200 that may be used in conjunction with an automated hair cutting system 100 to provide a function besides cutting hair. Sensors 208, indicator lights 212, and accelerometer 210 provide analogous functions to those described with regard to FIG. 2 regarding hair cutting device 200. Handle 1204 allows a user 102 to grip and position hair dye dispensing device 1202. Body 1206 may contain a container of hair dye; motors, valves, piping, and other elements to dispense hair dye; electronics and computing elements to control hair dye dispensing device 1202; and other functions. Comb 1208 allows specific hair to be gathered so that it may receive application of dye at the precise locations desired. And dispensing slot 1210 may spray, squeeze, or otherwise dispense hair dye at precise times and locations under control of automated hair cutting system 100. Embodiments of hair dye dispensing device 1202 may include the ability to dispense multiple dye types or colors of dye so that specific hair in specific locations on a user's 102 head may be dyed to create interesting styles.

FIG. 13 shows an embodiment of a stylus 1302 that may be used for providing reference point information. As previously described, reference points such as those shown in FIG. 1 (top of ear 152, back of user's 102 neck at a collar line 154, etc.) may be used to allow automated hair cutting system 100 to accurately determine precise locations on a user's 102 head even if position device 108 (or other embodiments of positioning devices) is not precisely located on user's 102 head. While hair cutting device 200 may be used for determining reference points with its cutter head 202 disabled, a light weight stylus 1302 such as the one shown in FIG. 13 may be easier to use. Sensors 208 shown on stylus 1302 allow precise location of tip 1306 to be determined while a user 102 holds it by handle 1304 and positions it to specific reference points as desired. Additional sensors 208 may be incorporated into stylus 1302 on the side not visible in FIG. 13. Stylus 1302 may contain a button, switch, or other element (these are not shown in FIG. 13) to allow a user to acknowledge to stylus 1302 that a reference point is being properly touched. Stylus 1302 may be battery operated or powered from a wired connection. It may also include wireless or wired interfaces to allow it to communicate to other elements of automated hair cutting system 100. Stylus body 1304 may be constructed from wood, metal, plastics, or other materials. Some embodiments of hair cutting device 200 or other hair cutting devices shown in this patent application may employ a stylus 1302 built into their structure. That is, a physical element, stylus tip 1306, or other feature suitable for the purpose of touching reference points may be present on such a hair cutting device or may extend through electronic control or manual extension from the structure of such a hair cutting device so that the benefit of higher precision in using a stylus for determining reference points may be achieved without the need for a separate stylus.

Those skilled in the art to which this application relates will appreciate that other and further additions, deletions, substitutions and modifications may be made to the described embodiments.

What is claimed is:

1. An automated system for cutting hair on a subject, comprising:

a hair cutting device, configured for manual manipulation, comprising a cutting mechanism and configured to engage said cutting mechanism to cut said hair; and a positioning device coupled to said subject, said positioning device configured to interact with said hair cutting device for determining a position of said hair cutting device relative to said subject, the positioning device having:

a frame configured to fit on and to be supported by a head of the subject; and a plurality of positioning interfaces secured to the frame, the plurality of positioning interfaces being configured to interact through signals with the hair cutting device for determining the position of the hair cutting device.

2. The system as recited in claim 1, further comprising a computing device configured to communicate with at least one of said hair cutting device and said positioning device, and operable to interact with a user.

3. The system as recited in claim 2, wherein said computing device is configured to receive a selected style and interact with at least one of said hair cutting device and said positioning device to direct cutting of said hair according to the selected style.

4. The system as recited in claim 1, further comprising at least one electronic sensor, said electronic sensor configured to interact with at least one of said hair cutting device and said positioning device for determining said position of said hair cutting device.

5. The system as recited in claim 1, wherein said system is configured to engage said cutting mechanism based on a hair style selected by said subject and said position of said hair cutting device relative to said subject.

6. The system as recited in claim 1, wherein said cutting mechanism comprises comb teeth and a plurality of engagable blades proximate said comb teeth, wherein said engagable blades and said comb teeth are configured for combing and extending said hair through said comb teeth and cutting said extended hair.

7. An automated system for cutting hair on a subject, comprising:

a hair cutting device, configured for manual manipulation, comprising a cutting mechanism and configured to engage said cutting mechanism to cut said hair; and a positioning device coupled to said subject, said positioning device configured to interact with said hair cutting device for determining a position of said hair cutting device relative to said subject;

wherein said positioning device utilizes signals that are measured to compute at least one of:

a position of said hair cutting device relative to said subject; and an orientation of said hair cutting device relative to said subject.

8. The system as recited in claim 1, further comprising at least one camera configured to generate at least one image of said subject, said image employable for determining at least one of:

a position of said hair cutting device relative to said subject; and an orientation of said hair cutting device relative to said subject.

9. The system as recited in claim 1, further comprising at least one camera configured to generate at least one image of said positioning device, said image employable for determining at least one of:

a position of said hair cutting device relative to said subject, an orientation of said hair cutting device relative to said subject, and placement of said positioning device on said subject.

10. The system as recited in claim 1, further comprising:

at least one sensor hub configured to interact with said hair cutting device and said positioning device.

11. A method of cutting hair on a subject, the method comprising:

providing a hair cutting device, configured for manual manipulation, said hair cutting device having a cutting mechanism and configured to engage said cutting mechanism to cut said hair; and providing a positioning device, said positioning device configured to couple onto said subject and interact with said cutting device for determining a position of said hair cutting device relative to said subject.

12. The method as recited in claim 11, further comprising providing a computing device configured to communicate with at least one of said hair cutting device and said positioning device and operable to interact with a user.

13. The method as recited in claim 11, wherein said method further comprises determining an orientation of said hair cutting device relative to said subject.

14. The method as recited in claim 12, wherein said computing device is further configured to guide a user to manually manipulate said hair cutting device.

15. The method as recited in claim 12, further comprising providing, by said computing device, style options to said subject, receiving a style selected by said subject, and engaging said hair cutting device to cut said subject's hair according to said selected style.

16. The method as recited in claim 11, wherein said hair cutting device comprises a comb for engaging and extending hair on said subject.

17. The method as recited in claim 11, wherein said positioning device is further configured to detect movement of said subject.

18. The method as recited in claim 11, further comprising calibrating said positioning device by articulating said hair cutting device about a plurality of physical features of said subject.

19. The method as recited in claim 11, wherein said hair cutting device comprises a camera.

20. A hair cutting system, comprising:

a hair cutting device, configured for manual manipulation, having a cutting mechanism, said cutting mechanism comprising comb teeth and a plurality of engagable blades proximate said comb teeth;

a positioning device, said positioning device configured to couple onto a subject and interact with said hair cutting device for determining a position of said hair cutting device relative to said subject; and a computing device configured to communicate with said hair cutting device and said positioning device, and operable to interact with a user for manual manipulation of said hair cutting device according to said determined position of said hair cutting device relative to said subject.

21. The system as recited in claim 1, wherein said signals comprise at least one of optical signals, light signals, structured light signals, radar signals, infrared signals, sound signals, ultrasonic signals, sonar signals, radio signals, radar signals, or electromagnetic signals.

22. The system as recited in claim 1, wherein said signals comprise visible features of said positioning device that may be observed with a camera.

* * * * *